US011735152B2

(12) United States Patent
Iwamoto et al.

(10) Patent No.: US 11,735,152 B2
(45) Date of Patent: Aug. 22, 2023

(54) MUSICAL SOUND GENERATION METHOD, MUSICAL SOUND GENERATION DEVICE, AND RECORDING MEDIUM

(71) Applicant: Roland Corporation, Shizuoka (JP)

(72) Inventors: Yoshinori Iwamoto, Shizuoka (JP); Takeshi Isogawa, Shizuoka (JP)

(73) Assignee: Roland Corporation, Shizuoka (JP)

( * ) Notice: Subject to any disclaimer, the term of this patent is extended or adjusted under 35 U.S.C. 154(b) by 329 days.

(21) Appl. No.: 17/012,061

(22) Filed: Sep. 4, 2020

(65) Prior Publication Data

US 2021/0065669 A1 Mar. 4, 2021

(30) Foreign Application Priority Data

Sep. 4, 2019 (JP) ..... 2019-161294

(51) Int. Cl.
*G10H 5/00* (2006.01)
*G10H 1/06* (2006.01)

(52) U.S. Cl.
CPC ..... *G10H 5/002* (2013.01); *G10H 1/06* (2013.01)

(58) Field of Classification Search
CPC ..... G10H 2240/145; G10H 1/0025; G10H 2210/341; G10H 7/00; G10H 2210/105; G10H 7/008; G10H 2240/131; G10H 1/42; G10H 1/0033; G10H 1/344; G10H 2250/641; G10H 1/40; G10H 2210/005; G10H 1/183; G10H 1/186; G10H 2210/031; G10H 2240/121; G10H 5/00; G10H 1/182; G10H 1/185; G10H 1/187; G10H 3/00
See application file for complete search history.

(56) References Cited

U.S. PATENT DOCUMENTS 4,082,027 A 4/1978 Hiyoshi et al.
10,373,595 B2 * 8/2019 Sato ..... G10H 7/045
(Continued)

FOREIGN PATENT DOCUMENTS

EP 2416311 2/2012
EP 3789998 A1 * 3/2021 ..... G10H 1/06
(Continued)

OTHER PUBLICATIONS

"Search Report of Europe Counterpart Application", dated Feb. 1, 2021, p. 1-p. 10.

*Primary Examiner* — Marlon T Fletcher
(74) *Attorney, Agent, or Firm* — JCIPRNET

(57) ABSTRACT

A musical sound generation device includes a control device which, when a performance operator among a plurality of performance operators has been operated for a part that has been set to sound a predetermined number of simulated voices of an analog synthesizer, assigns a sounding parameter of one or two or more voices, which form a timbre of a simulated voice of the analog synthesizer corresponding to the operated performance operator and are selected from a plurality of sounding voices, to a sound generation circuit, and assigns, to the sound generation circuit, an information set selected from a plurality of information sets and each include a variation value that applies a variation to the sounding parameter of the one or two or more voices, and a sound generation circuit that performs a sounding process of the one or two or more voices using the sounding parameter and the information set.

12 Claims, 22 Drawing Sheets

(56) References Cited

U.S. PATENT DOCUMENTS

| | | | | |
|---|---|---|---|---|
| 10,964,299 | B1 * | 3/2021 | Estes | G10H 1/0025 |
| 2006/0236848 | A1 * | 10/2006 | Stone | G10H 1/186 84/615 |
| 2011/0219941 | A1 | 9/2011 | Tsuchiya et al. | |
| 2012/0174737 | A1 * | 7/2012 | Risan | G10H 7/02 84/622 |
| 2021/0110801 | A1 * | 4/2021 | Estes | G10H 7/008 |
| 2021/0110802 | A1 * | 4/2021 | Estes | G10H 1/0025 |

FOREIGN PATENT DOCUMENTS

| | | | | |
|---|---|---|---|---|
| JP | H02304490 | | 12/1990 | |
| JP | H11133966 | | 5/1999 | |
| JP | 2000352981 | | 12/2000 | |
| JP | 2000352983 | | 12/2000 | |
| JP | 2001092461 | | 4/2001 | |
| JP | 2006094153 | | 4/2006 | |
| WO | WO-2007123549 | A1 * | 11/2007 | G10H 1/183 |
| WO | WO-2007130056 | A1 * | 11/2007 | G10H 1/0066 |
| WO | WO-2019049383 | A1 * | 3/2019 | G10H 1/00 |

* cited by examiner

| Partial 1 | Partial 2 |
|---|---|
| Waveform: Square | Waveform: Triangle |
| Pitch Offset: 0[cent] | Pitch Offset 0[cent] |
| Filter Cutoff: 100 | Filter Cutoff: 80 |
| Envelope Attack Time: 0 | Envelope Attack Time: 1 |
| Envelope Release Time: 100 | Envelope Release Time: 80 |
| Number of virtual voices: 8(Common to partials) | |
| Variation depth: 100(Common to partials) | |

FIG. 7

Unused list

| Virtual voice [0] | Virtual voice [1] | Virtual voice [2] | Virtual voice [3] |
|---|---|---|---|
| No note is used | No note is used | No note is used | No note is used |

Used list

| None |
|---|

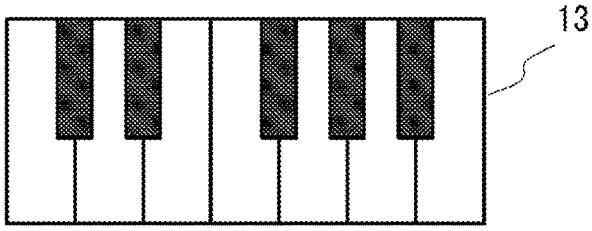

Timbre data

| Number of virtual voices:4 |
|---|
| Variation depth:100 |

Virtual voice parameters

| Variation value 1 (Virtual voice [0], Oscillator 1) |
|---|
| Variation value 2 (Virtual voice [0], Oscillator 2) |
| Variation value 1 (Virtual voice [1], Oscillator 1) |
| Variation value 2 (Virtual voice [1], Oscillator 2) |
| Variation value 1 (Virtual voice [2], Oscillator 1) |
| Variation value 2 (Virtual voice [2], Oscillator 2) |
| Variation value 1 (Virtual voice [3], Oscillator 1) |
| Variation value 2 (Virtual voice [3], Oscillator 2) |

FIG. 15

MUSICAL SOUND GENERATION METHOD, MUSICAL SOUND GENERATION DEVICE, AND RECORDING MEDIUM

CROSS-REFERENCE TO RELATED APPLICATION

This application claims the priority benefit of Japan Patent Application No. 2019-161294, filed on Sep. 4, 2019. The entirety of the above-mentioned patent application is hereby incorporated by reference herein and made a part of this specification.

BACKGROUND

Technical Field

The disclosure relates to a musical sound generation method, a musical sound generation device, and a recording medium storing a program.

Description of Related Art

Analog synthesizers include analog circuits such as oscillators, filters, and amplifiers, and their operations are more unstable than those of digital synthesizers due to variations in components that constitute each circuit. Such instability appears, for example, as variations in the pitch of the generated voice. However, many users prefer voices having such variations as voices particular to analog synthesizers which are richer in variety than voices of digital synthesizers. Thus, there is a digital synthesizer that simulates voices generated by an analog synthesizer (for example, Patent Document 1). Other technologies relating to the disclosure include Patent Documents 2 to 6.

PATENT DOCUMENTS

[Patent Document 1] Japanese Patent Laid-Open No. 11-133966

[Patent Document 2] Japanese Patent Laid-Open No. 2-304490

[Patent Document 3] Japanese Patent Laid-Open No. 2000-352981

[Patent Document 4] Japanese Patent Laid-Open No. 2000-352983

[Patent Document 5] Japanese Patent Laid-Open No. 2001-092461

[Patent Document 6] Japanese Patent Laid-Open No. 2006-094153

SUMMARY

One aspect of the disclosure provides a musical sound generation method including a control device assigning, when a performance operator among a plurality of performance operators has been operated for a part that has been set to sound a predetermined number of simulated voices of an analog synthesizer, a sounding parameter of one or two or more voices, which form a timbre of a simulated voice of the analog synthesizer corresponding to the operated performance operator and are selected from a plurality of voices capable of being sounded, to a sound generation circuit, the control device assigning, to the sound generation circuit, an information set selected from a plurality of information sets which are prepared for the predetermined number of simulated voices and each include a variation value that applies a variation to the sounding parameter of the one or two or more voices, and the sound generation circuit performing a sounding process of the one or two or more voices using the sounding parameter and the information set.

BRIEF DESCRIPTION OF THE DRAWINGS

FIG. 7 shows an example of a format of timbre data according to the embodiment.

FIG. 15 is an explanatory diagram of an unused list, a used list, and a keyboard immediately after initialization in a specific example.

DESCRIPTION OF THE EMBODIMENTS

Figure 1:
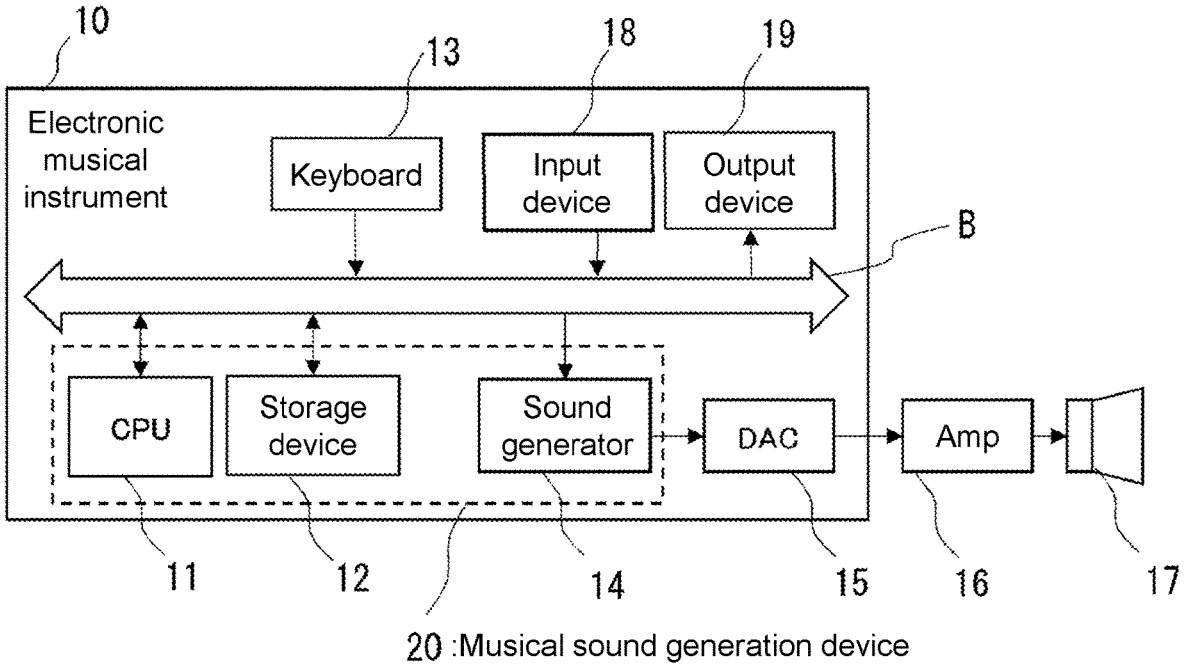
FIG. 1 shows an exemplary circuit configuration of an electronic musical instrument according to an embodiment.

To generate voices of an analog synthesizer through a digital synthesizer, it is conceivable to apply variations to parameters determining the timbre such as a pitch and a filter and to randomly generate the variations.

Here, the number of voices that can be simultaneously sounded by a polyphonic analog synthesizer is about 4 to 8 and variations in pitch or the like occur within that number of voices. On the other hand, the number of voices that can be simultaneously sounded by a digital synthesizer has increased to four or more times higher than this, such as 32 to 128, due to technological progress.

If variations are applied to all voices that can be simultaneously sounded by the digital synthesizer and random elements are applied to the occurrence of variations for each performance, there is a problem that the nuances of sound (how the sound is perceived) deviate from those of sound produced by the analog synthesizer. On the other hand, if the number of voices that can be simultaneously sounded by the digital synthesizer is limited to the same number as that of the analog synthesizer, there is a problem that the full capability of the digital synthesizer cannot be exhibited.

The disclosure provides a musical sound generation device and an electronic musical instrument capable of generating a sound having features of an analog synthesizer.

A musical sound generation method and a musical sound generation device according to an embodiment will be described below.

The musical sound generation method includes the following process.

(1) When a performance operator among a plurality of performance operators has been operated for a part that has been set to sound a predetermined number of simulated voices of an analog synthesizer, a control device assigns a sounding parameter of one or two or more voices, which form a timbre of a simulated voice of the analog synthesizer corresponding to the operated performance operator and are selected from a plurality of voices capable of being sounded, to a sound generation circuit.

(2) The control device assigns, to the sound generation circuit, an information set selected from a plurality of information sets which are prepared for the predetermined number of simulated voices and each include a variation value that applies a variation to the sounding parameter of the one or two or more voices.

(3) The sound generation circuit performs a sounding process of the one or two or more voices using the sounding parameter and the information set.

According to the musical sound generation method, the control device assigns a sounding parameter and an information set to the sound generation circuit and the sound generation circuit performs a sounding process of the one or two or more voices that form the timbre of the analog synthesizer using the sounding parameter and the information set. This allows the sound generation circuit to generate a musical sound having features (variations in pitch or the like) of the analog synthesizer. Thus, it is possible to sound voices having features of the analog synthesizer, that is, simulated voices having the nuances of the analog synthesizer.

The "predetermined number" is determined, for example, according to the number of sounding voices of the analog synthesizer to be simulated. For example, the "predetermined number" is a number equal to or less than the number of sounding voices of the analog synthesizer to be simulated or is a number greater than the number of sounding voices of the analog synthesizer to be simulated but limited to such an extent that the nuances of sound of the analog synthesizer to be simulated are not impaired. For example, the predetermined number is up to twice the number of sounding voices of the analog synthesizer. For example, if the number of sounding voices of the analog synthesizer is 8, the predetermined number is 8 or less or a number that is greater than 8 by 8. By limiting the number of simulated voices to the predetermined number, it is possible to make the simulated voices closer to voices of the analog synthesizer to be simulated as compared to when all voices capable of being sounded are used to sound simulated voices.

The variation value may be calculated from a random number and information indicating the variation depth (magnitude) or a value indicating a variation measured using an actual analog synthesizer device may be used instead of a random number.

In the musical sound generation method, when the one or two or more voices are generated using a plurality of oscillators included in the sound generation circuit, the information set may include variation values corresponding to the oscillators. Here, one oscillator may be provided for one voice or two or more oscillators may be provided for one voice.

For the musical sound generation method, it is possible to adopt a configuration in which unused information sets among the plurality of information sets are registered in an unused list, each of the information sets in the unused list includes identification information of a performance operator that has triggered assignment to the sound generation circuit in the past, and when an information set is selected from the unused list in response to operation of a certain performance operator among the plurality of performance operators, an information set including identification information of the certain performance operator is preferentially selected. In another configuration, a voice having substantially the same features as a voice generated according to the operation of the certain performance operator may be generated as a voice of the analog synthesizer when the certain performance operator has been operated again immediately after the operation of the certain performance operator ends. By adopting these configurations, it is possible to simulate features of voices of such an analog synthesizer. The identification information of the performance operator is, for example, a note number.

For the musical sound generation method, it is also possible to adopt a configuration in which, when an information set assigned to the sound generation circuit is added with information indicating reference to a variation value by the sound generation circuit and removed from the unused list and, when sounding of the one or two or more voices has ended, the information indicating reference to a variation value by the sound generation circuit is removed and the information set is again registered in the unused list.

Further, in the musical sound generation method, it is possible to adopt a configuration in which the sounding parameter includes a pitch. The sounding parameter can also include parameters relating to a filter, an amplifier, and an envelope in addition to a pitch.

Furthermore, in the musical sound generation method, it is possible to adopt a configuration in which the plurality of information sets are prepared for a part that has been set to sound simulated voices of the analog synthesizer and are not prepared for a part that has been set to sound voices other than the simulated voices of the analog synthesizer. As a result, it is possible to simultaneously generate a simulated voice of the analog synthesizer and a voice other than simulated voices of the analog synthesizer.

A musical sound generation method and a musical sound generation device according to an embodiment will be described below with reference to the drawings. The configuration according to the embodiment is an example and the disclosure is not limited to the configuration.

<Composition of Electronic Musical Instrument>

FIG. 1 shows an exemplary circuit configuration of an electronic musical instrument according to an embodiment. The electronic musical instrument according to the present embodiment is a digital synthesizer. In FIG. 1, the electronic musical instrument 10 includes a central processing unit (CPU) 11, a storage device 12, a keyboard 13, a sound generator 14, an input device 18, and an output device 19 which are interconnected via a bus B. A digital analog converter (DAC) 15 is connected to the sound generator 14, the DAC 15 is connected to an amplifier 16, and the amplifier 16 is connected to a speaker 17. The CPU 11, the storage device 12, and the sound generator 14 operate as a musical sound generation device 20.

Each key included in the keyboard 13 is an example of a "performance operator." The CPU 11 is an example of a "controller," a "control device," or a "processor." The sound generator 14 is an example of a "sound generation circuit."

The storage device 12 includes a main storage device and an auxiliary storage device. The main storage device is used as a storage area for programs and data, a work area for the CPU 11, and the like. The main storage device is formed of, for example, a random access memory (RAM) or a combination of a RAM and a read only memory (ROM). The auxiliary storage device is used as a storage area for programs and data, a waveform memory for storing waveform data, and the like. The auxiliary storage device is, for example, a flash memory, a hard disk, a solid state drive (SSD), or an electrically erasable programmable ROM (EEPROM).

The input device 18 includes operating elements such as keys, buttons, and knobs. The input device 18 is used to input various information or data to the electronic musical instrument. This information or data includes data for making various settings for the electronic musical instrument 10.

The output device 19 is, for example, a display and displays information such as parameters set in the electronic musical instrument 10. The keyboard 13 is an example of a performance operator and has a plurality of keys. The performance operator may be other than a keyboard (for example, a pad).

The CPU 11 performs various processes by executing programs stored in the storage device 12. For example, the CPU 11 receives data and information (such as parameters relating to a timbre) that has been input using the input device 18 and stores the data and information in the storage device 12 as timbre information.

The sound generator 14 is a PCM-format sound generation circuit having a built-in waveform memory. The sound generator 14 includes, for example, a group of sounding circuits (referred to as reproduction circuits) corresponding to the number of voices that can be sounded by the electronic musical instrument 10. In the present embodiment, the sound generator 14 has a group of 128 reproduction circuits since 128 voices can be sounded at the same time. The sound generator 14 can be constructed using a dedicated or general-purpose integrated circuit such as an application specific integrated circuit (ASIC), a field programmable gate array (FPGA), and a digital signal processor (DSP). The sound generator 14 can also be constructed as a software synthesizer that operates on a computer.

When any key of the keyboard 13 is depressed, the CPU 11 supplies a sounding instruction corresponding to the depressed key to a corresponding reproduction circuit of the sound generator 14. The reproduction circuit reads waveform data corresponding to a reference voice of a real voice according to the sounding instruction from the storage device 12 and writes the waveform data in the waveform memory (creates a waveform), and generates and outputs a reproduced sound (musical sound signal) according to parameters of timbre information (such as a pitch, a filter, an amplifier, and an envelope) preset in the storage device 12.

Here, the pitch is controlled by controlling the rate of reproduction. The frequency components of sound are controlled by a predetermined filter type and cutoff frequency. The volume is controlled according to predetermined parameters regarding changes over time (such as an attack time, a decay time, a sustain level, and a release time). When an envelope has been set for the pitch or filter, change control according to the envelope is performed.

The musical sound signal generated by the sound generator 14 is supplied to the DAC 15, converted into an analog signal by the DAC 15, amplified by the amplifier 16, and emitted from the speaker 17. When the depressed key is released, the CPU 11 supplies a mute instruction corresponding to the released key to the corresponding reproduction circuit of the sound generator 14. In accordance with the timbre information, the reproduction circuit starts attenuating the real voice according to the mute instruction and stops outputting the musical sound signal upon completion of the attenuation. Along with this, the musical sound emitted from the speaker 17 is muted.

<Generation of Simulated Voice of Analog Synthesizer>

The electronic musical instrument 10 (digital synthesizer) can generate a musical sound (a simulated voice having a variation in pitch) that simulates a musical sound produced by the analog synthesizer through digital control. A configuration for generating a simulated voice of the analog synthesizer will be described below.

Figure 2:
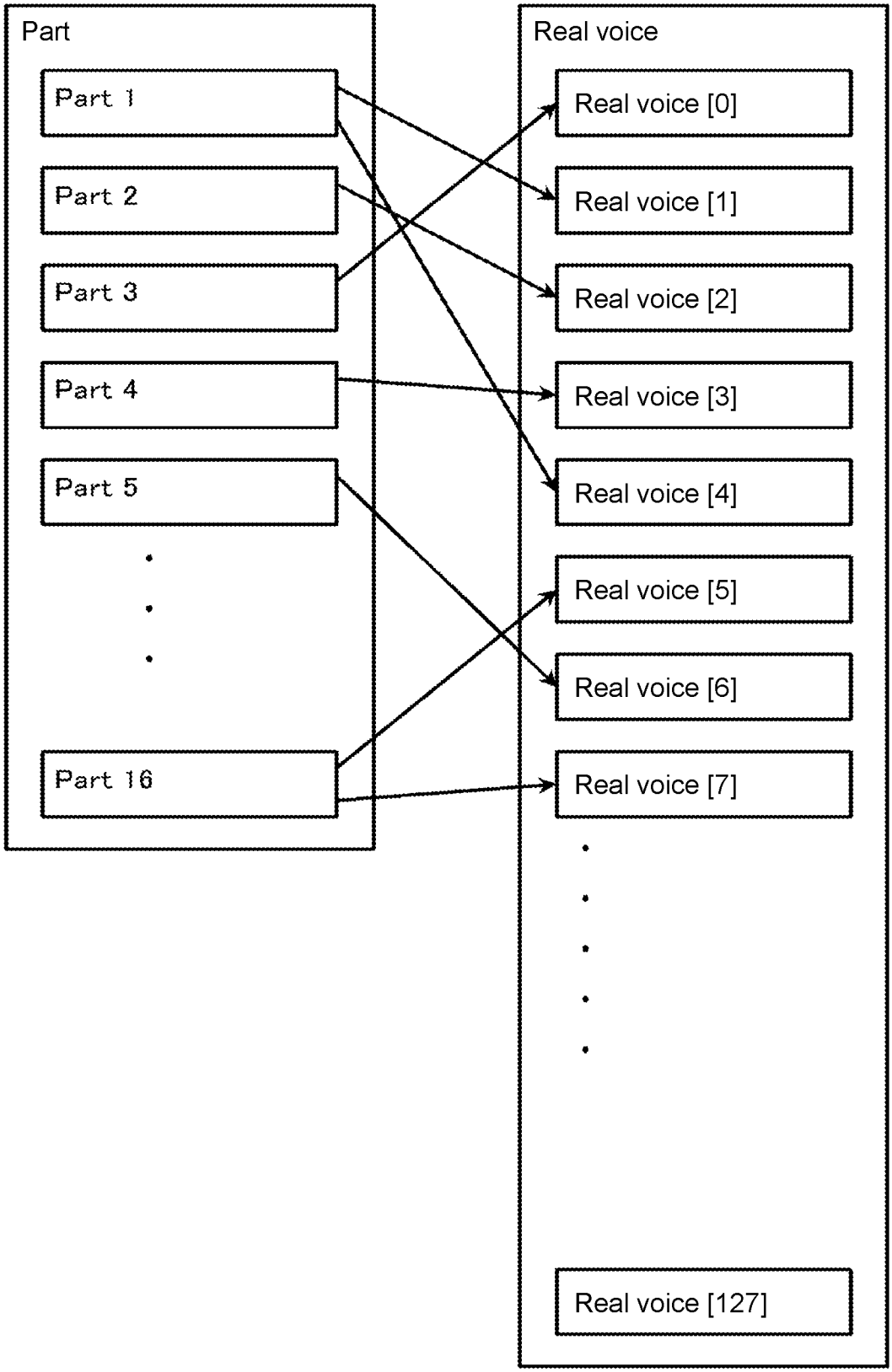
FIG. 2 is a diagram schematically showing a relationship between parts and real voices.
Figure 3:
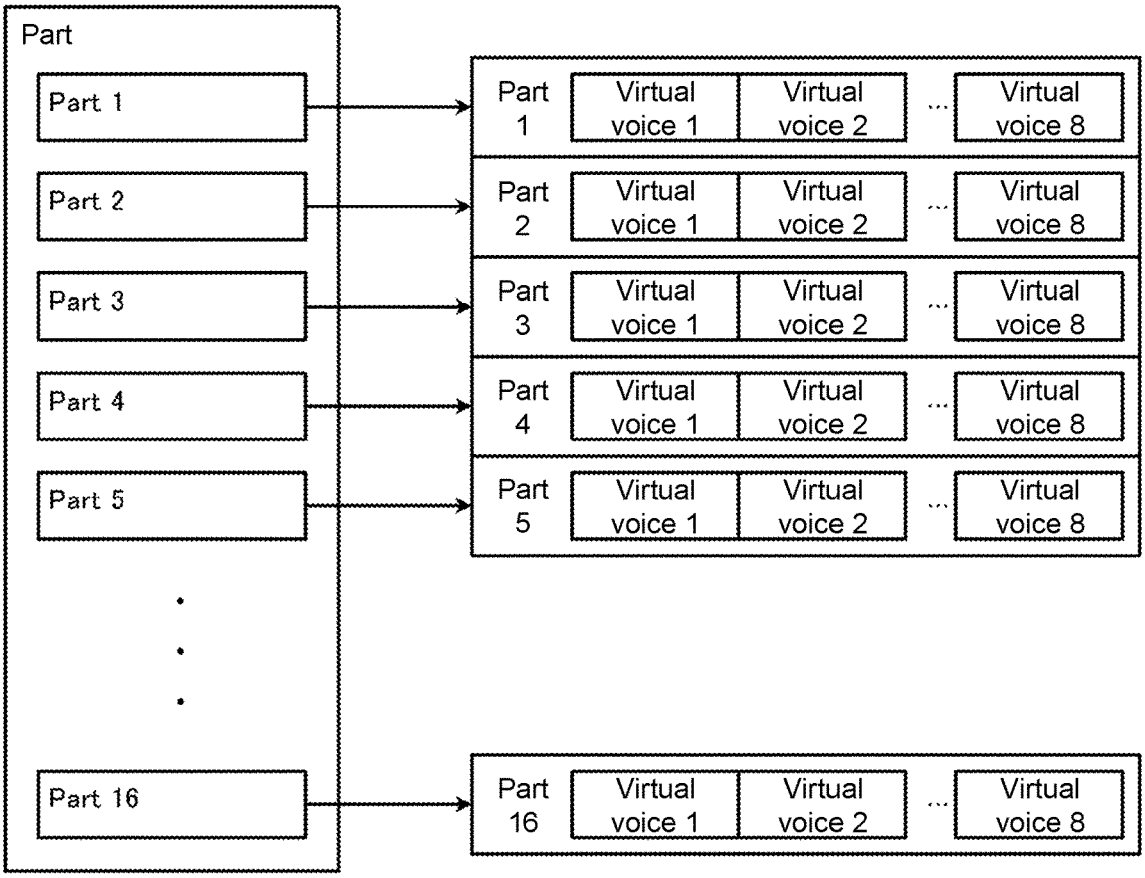
FIG. 3 is a diagram schematically showing a relationship between parts and virtual voices.
Figure 4:
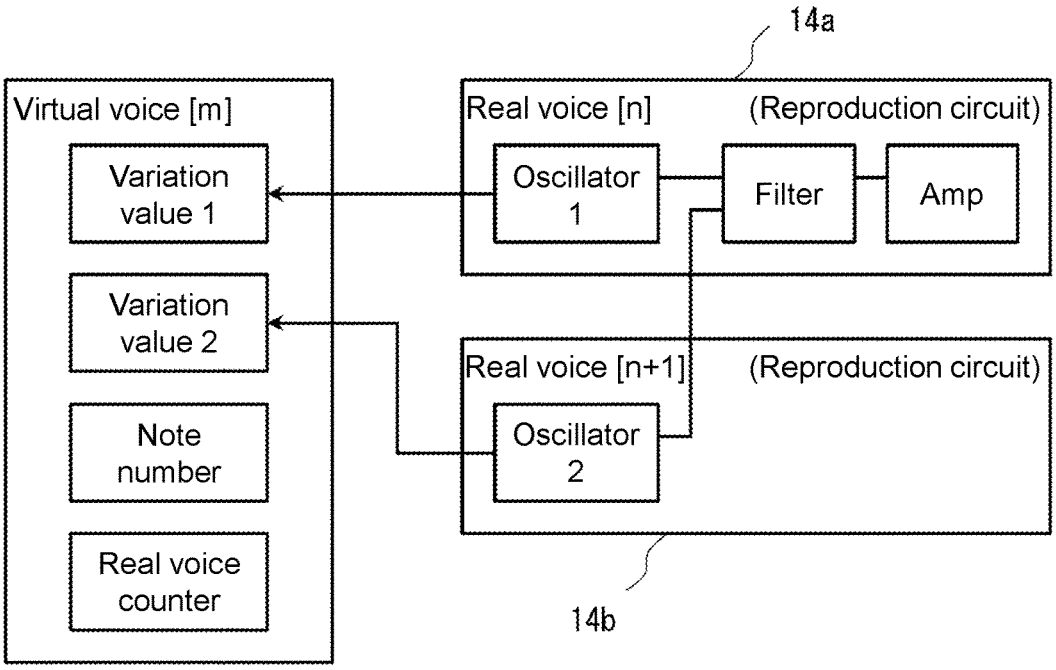
FIG. 4 is a diagram schematically showing a relationship between a virtual voice and real voices.

FIG. 2 is a diagram schematically showing a relationship between parts and real voices. FIG. 3 is a diagram schematically showing a relationship between parts and virtual voices. FIG. 4 is a diagram schematically showing a relationship between a virtual voice and real voices.

The storage device 12 (FIG. 1) stores information relating to parts, information relating to real voices, and information relating to virtual voices, which the sound generator 14 references to generate a musical sound corresponding to a key depression on the keyboard 13.

In the electronic musical instrument 10 according to the embodiment, a plurality of parts (Parts 1 to 16 in the example shown in FIG. 2) are prepared such that a plurality of timbres can be played by the digital synthesizer. Each part indicates a voice part or a musical instrument and the timbres may be different or the same for the parts. A timbre to be set for each part is determined by operating the input device 18.

Simulated voices of an analog synthesizer are assigned to one or two or more of the plurality of parts. Simulated voices of a plurality of analog synthesizers having different timbres may be assigned to two or more parts. Musical instrument sounds of instruments other than an analog synthesizer such as a "piano" and a "rhythm" may also be assigned to some of the plurality of parts.

In the present embodiment, a sound (voice) that can be sounded by the digital synthesizer is referred to as a "real voice." A timbre corresponding to a part is created by one sound component or a combination of two or more sound components which are called "partials." One partial includes one or a plurality of voices (that is, real voices).

The characteristics of a sound are determined by the loudness (volume), pitch, and timbre (frequency components) of the sound. Each of the plurality of reproduction circuits included in the sound generator 14 includes an oscillator, a filter, and an amplifier (Amp) as shown in FIG. 4.

The oscillator creates a waveform that is a basis of the timbre. The pitch is determined by the depressed key of the keyboard 13. The filter is a section that cuts or emphasizes a sound in a certain frequency region to form a timbre (waveform features of the sound). The amplifier is a section that determines the change over time in volume until the sound ends. A change over time in pitch, filter characteristics (such as the cutoff frequency), volume, or the like is called an envelope and each reproduction circuit has a function of changing the envelope (which is called an envelope generator). However, the CPU 11 may operate as an envelope generator.

Information relating to each real voice includes parameters of the pitch, the filter, the amplifier, and the envelope described above as information necessary for sounding, which can be managed, for example, by a real voice assigner. The information of a real voice is set in (referenced by) a reproduction circuit corresponding to the real voice which is assigned according to a sounding instruction based on a key depression. For example, a circuit forming the CPU 11 and/or the sound generator 14, and the like can operate as the real voice assigner.

In the present embodiment, the storage device 12 stores, for example, information indicating 16 types of Parts 1 to 16 and information indicating 128 types of real voices (real voices [0] to [127]) as shown in FIG. 2. One or a plurality of performance operators can be associated with each part. For example, a group of one half of the performance operators on the higher-pitch side of the keyboard is associated with the Part 1, and the group of the other half of the performance operators on the lower-pitch side of the keyboard is associated with the Part 2. Arrows pointing from each part to real voices indicate real voices that are dynamically assigned (designated) when one performance operator included in a performance operator group corresponding to the part is operated.

In FIG. 2, for example, when a performance operator corresponding to the Part 1 is operated, the real voices [1] and [4] are assigned by a sounding instruction. This means that the timbre of the Part 1 is created by one or more partials including real voices [1] and [4]. Alternatively, when a performance operator corresponding to the Part 2 is operated, the real voice [2] is assigned by a sounding instruction. When a performance operator corresponding to the Part 3 is operated, the real voice [0] is assigned by a sounding instruction. Further, when another performance operator corresponding to the Part 1 is operated, another real voice is assigned. Each part is associated with one or more real voices that are elements of the timbre in response to operation of a performance operator corresponding to the part as described above. Such information indicating the relationship between the parts and the real voices is also stored in the storage device 12.

Information of a real voice further includes an identifier (number) of (information relating to) a virtual voice associated with the real voice. The association between real voices and virtual voices will be described later. The real voices [0] to [127] are commonly used among parts as element data for creating a timbre.

The storage device 12 stores information relating to virtual voices that can be associated with each of the Parts 1 to 16 as shown in FIG. 3. Information on the number of one or two or more virtual voices whose upper limit is a predetermined number can be associated with each of the Parts 1 to 16.

In the present embodiment, a simulated voice of the analog synthesizer generated by the electronic musical instrument 10 is referred to as a "virtual voice." Information relating to virtual voices includes information for generating simulated voices of the analog synthesizer by using one or more partials (one or more real voices) in a part to which settings for sounding the simulated voices of the analog synthesizer are assigned. Virtual voice information is prepared and managed on a part-by-part basis and virtual voice information for a part is information dedicated to the part and is not assigned to any part other than the part.

A predetermined number of information sets relating to virtual voices (simulated voices) are stored in association with each part for simulated voices of the analog synthesizer. In the present embodiment, the upper limit (maximum value) of each of the number of virtual voices (simulated voices) and the number of information sets in one part is set to 8 taking into consideration the number of voices that can be simultaneously sounded by the analog synthesizer to be simulated (about 4 to 8). The upper limit of the number of virtual voices is common to the parts. However, the upper limit may be more than 8 (for example, 10 or 9) or less than 8 (for example, 7 to 3). The number of virtual voices can be appropriately set within a range of 1 to the upper limit. It is preferable that the range of the upper limit be set, for example, to ¼ or less of the number of voices that can be simultaneously sounded by the digital synthesizer, on the basis of the number of voices that can be simultaneously sounded by the analog synthesizer to be simulated. When the number of virtual voices for a part is set to 0, sounding using a virtual voice is not performed for the part.

A virtual voice is a voice which causes a variation to be applied to a sounding parameter included in information relating to real voices forming one or two or more partials that form the timbre of a simulated voice in a process of generating the simulated voice. This sounding parameter is an example of "a sounding parameter of one or two or more voices forming the timbre of a simulated voice of the analog synthesizer."

Information relating to virtual voices includes information indicating variations in sounding parameters (also referred to as variation parameters or variation values). Sounding parameters, that is, parameters relating to generation of a sound are, for example, information on the pitch, the filter, the amplifier, and their envelopes (changes over time). The sounding parameters to which variations are to be applied are, for example, but not limited to, the pitch, the cutoff frequency of the filter, the attack time and release time relating to the volume, the envelope for at least one of the pitch, the filter, and the amplifier.

One virtual voice corresponds to one key depression and real voices required to form one or two or more partials (sound components) are used with one key depression. Therefore, information of one virtual voice has a number of variation values corresponding to the number of partials forming the timbre data (variation values corresponding to real voices forming the partials). This is because one voice simulates variations in each of a plurality of oscillators included in the analog synthesizer.

The parameters regarding virtual voices include the number of virtual voices (the number of voices of the analog synthesizer to be simulated) and a value indicating the variation depth (magnitude), which can be managed, for example, by the virtual voice assigner. The variation increases as the variation depth increases and decreases as the variation depth decreases. When the number of virtual voices is 0, the virtual voice mechanism is not used. For example, the circuit forming the CPU 11 and/or the sound generator 14, and the like can operate as the virtual voice assigner. The user of the electronic musical instrument 10 can manually operate the operation of the virtual voice assigner using the input device 18.

For example, a random number generated using a random number generator can be applied to the variation values. In this case, the trend in variations can be changed by changing a random number seed set in the random number generator (a numerical value set as an initial state in calculating a random number). For example, the virtual voice assigner has a random number seed that is common to virtual voices belonging to the same part and updates the random number seed when a timbre has been selected or when the number of virtual voices has been changed. However, when the value indicating the variation depth has been changed, the virtual voice assigner does not update the random number seed. Therefore, the variation depth can be changed while maintaining the trend in variations among virtual voices.

Each virtual voice holds a note number (information indicating a key or pitch) that has been sounded (see FIG. 4). Unused virtual voices are managed in a list. A counter indicating the number of real voices that reference the virtual voice is set for each virtual voice (see FIG. 4). The count value of the real voice counter indicates the number of reproduction circuits with real voices assigned which reference variation values and indicates 0 when there is no reproduction circuit that references the variation values. Thus, when the count value of the real voice counter is greater than 0, the count value indicates that the sound generator 14 references a variation value. That is, the count value of the number of real voices corresponds to information on reference to variation values by the sound generator 14. Real voices are used and no virtual voice is used for a part to which a timbre of an instrument other than the analog synthesizer such as a piano or a rhythm instrument is assigned.

The total number of voices that can be sounded by the digital synthesizer is, for example, 32 to 128, and the number of real voices prepared for the electronic musical instrument 10 according to the present embodiment is 128. On the other hand, the number of virtual voices of each part simulating the analog synthesizer is about the number of voices of the analog synthesizer (for example, 4 to 8). That is, in the present embodiment, the number of voices for a part for sounding simulated voices of the analog synthesizer is limited and variations are applied to voices within the limited number of voices, whereby it is possible to generate a simulated voice of the analog synthesizer having a particular nuance.

FIG. 4 schematically shows the relationship between a virtual voice and real voices. FIG. 4 shows, as an example, the relationship between reproduction circuits 14*a* and 14*b* that perform reproduction processing for two real voices [n] and [n+1] and information of one virtual voice [m]. Here, n and m are positive integers.

One virtual voice is associated with one key of the keyboard 13 and reproduction processing using one or more real voices forming one or two or more partials used for sounding corresponding to the key is performed using information of the one or more real voices.

The real voices [n] and [n+1] are real voices which have been associated with a part of the analog synthesizer through operation of a performance operator, and the timbre of the part is formed of one partial, that is, a combination of the real voices [n] and [n+1]. The reproduction processing for the real voices [n] and [n+1] is performed respectively by the reproduction circuits 14*a* and 14*b* included in the plurality of reproduction circuits of the sound generator 14.

The reproduction circuit 14*a* has an oscillator 1, a filter, and an amplifier, and performs reproduction processing for the real voice [n] using these. Similar to the reproduction circuit 14*a*, the reproduction circuit 14*b* has an oscillator 2, a filter, and an amplifier, and performs reproduction processing for the real voice [n+1].

However, a waveform of the real voices (partials) is generated from a combination of a waveform created by the oscillator 1 of the reproduction circuit 14*a* for the real voice [n] and a waveform created by the oscillator 2 of the reproduction circuit 14*b* for the real voice [n+1]. Thus, the output of the oscillator 2 is connected to the filter of the reproduction circuit 14*a* and the filter and amplifier of the reproduction circuit 14*b* are not used. Therefore, the filter and amplifier of the reproduction circuit 14*b* are not shown. The oscillator 2 may also use the filter and the amplifier of the reproduction circuit 14*b* to perform reproduction processing for the real voice [n+1].

For example, the variation value 1 for the pitch of the real voice [n] and the variation value 2 for the pitch of the real voice [n+1] are included in information relating to the virtual voice [m] as variation values (for the partials) of the virtual voice [m]. The reproduction circuits 14*a* and 14*b* acquire the corresponding variation values respectively, thereby making it possible to generate and output a reproduced sound with the variation values reflected in the pitch (with the pitch controlled using the variation values) (a simulated voice of the analog synthesizer).

Information relating to virtual voices can also include information indicating variations in the envelopes for voices if this is necessary to simulate voices of the analog synthesizer.

<Processing in Musical Sound Generation Device>

Figure 5:
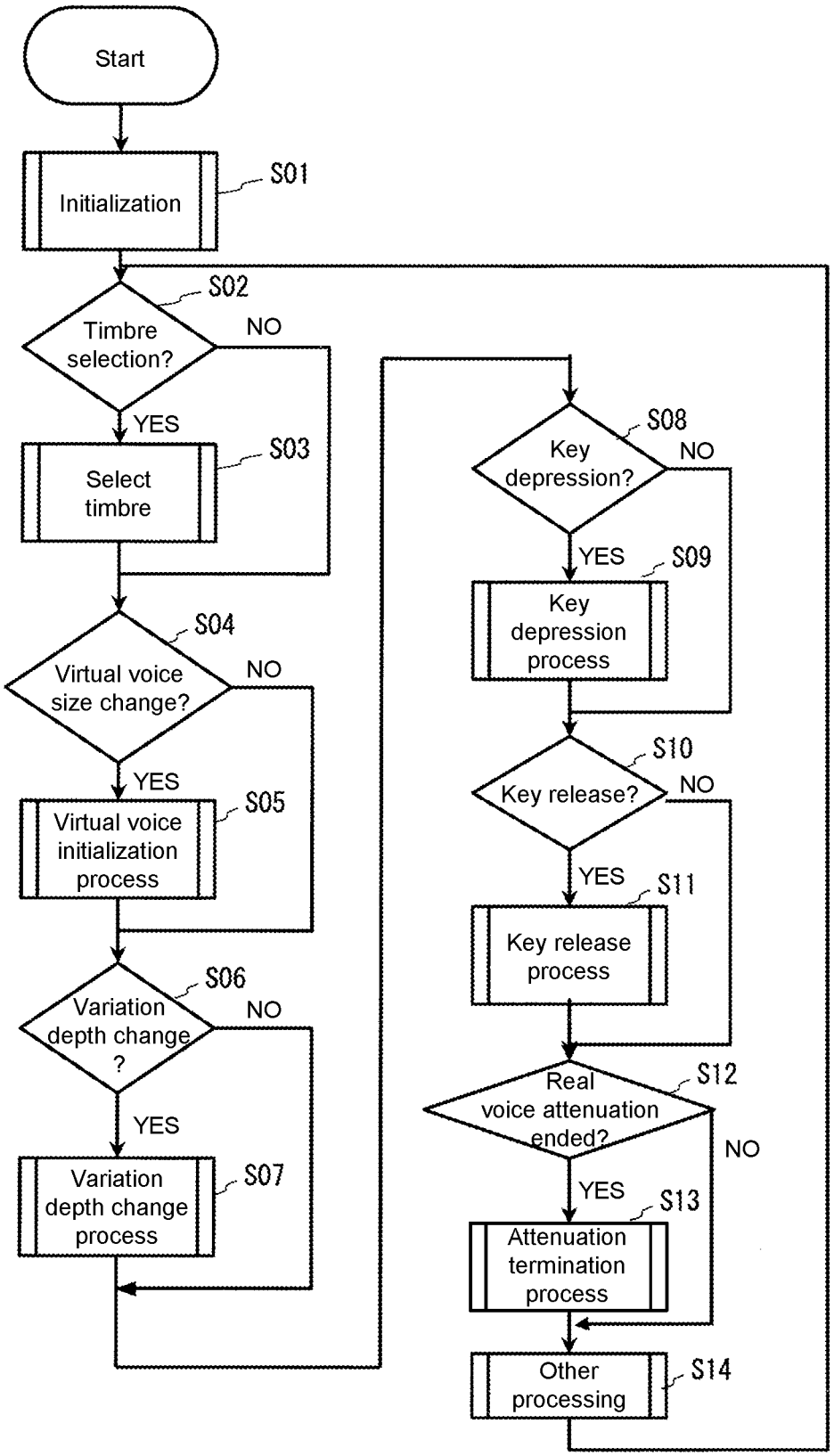
FIG. 5 is a flowchart showing an example of a main routine executed by a musical sound generation device.

FIG. 5 is a flowchart showing a main routine executed by the musical sound generation device. A process shown in FIG. 5 is performed by the CPU 11 that operates, for example, as the real voice assigner and the virtual voice assigner. In the following description, a sounding parameter to which a variation is applied will be exemplified by the pitch as an example.

In S01, an initialization process is performed. In the initialization process, the CPU 11 performs initialization (default setting) of parts, the timbre of each part, virtual voices, real voices, and the like. The default setting may be performed automatically or an editing environment using the input device 18 and the output device 19 may be provided to the user.

In S02, the CPU 11 determines whether or not a timbre selection request has been input. The user can select a timbre by designating a timbre selection request using the input device 18. If it is determined that no timbre selection request has been input (NO in S02), the process proceeds to S04. On the other hand, if it is determined that a timbre selection request has been input (YES in S02), the process proceeds to S03.

Figure 6:
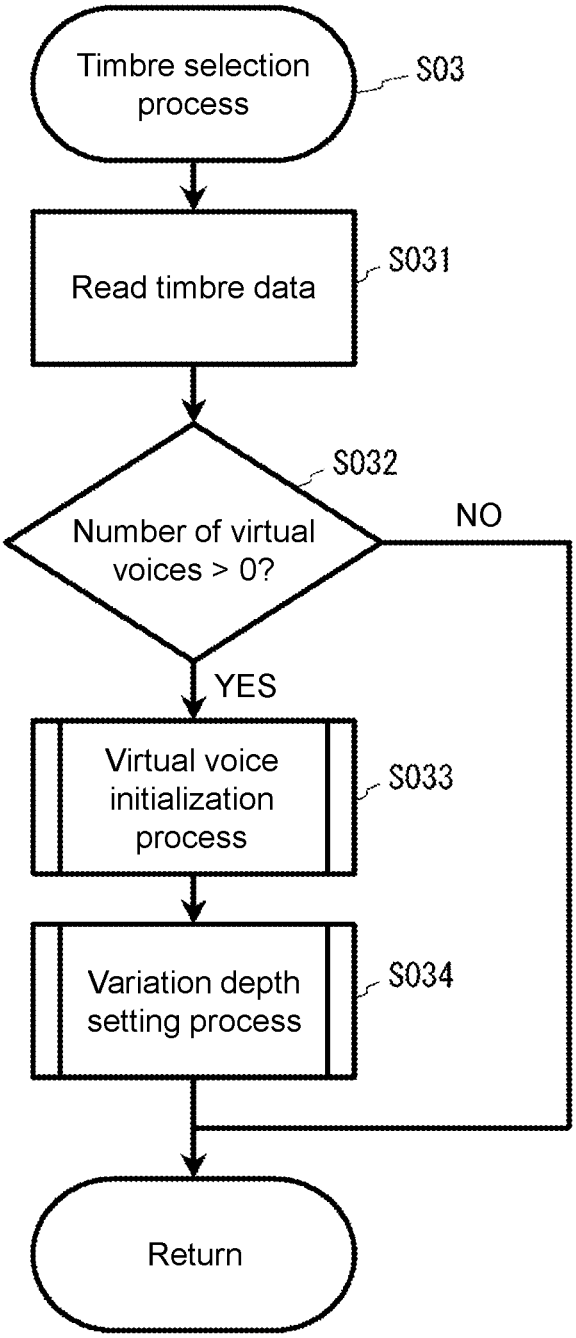
FIG. 6 is a flowchart showing an example of a subroutine of a timbre selection process.

In S03, a subroutine of the timbre selection process is performed. FIG. 6 is a flowchart showing an example of a subroutine of the timbre selection process. In the timbre selection process, the CPU 11 reads timbre data stored in the storage device 12 into a memory (a work area of the main storage device) (S031).

FIG. 7 shows an example of a format of the timbre data according to the embodiment. The timbre data includes sets of parameters relating to partials that form the timbre. The parameters relating to each partial include a waveform, a pitch offset value, a cutoff frequency, an envelope attack time, and an envelope release time and these can be used as parameters for applying variations. In the embodiment, the number of virtual voices and a value indicating the variation depth are prepared as parameters common to partials. However, the number of virtual voices and the variation depth may be prepared for each partial. Parameters other than those shown in FIG. 7 may also be included in the timbre data.

In S032, the CPU 11 determines whether or not the number of virtual voices included in the timbre data is greater than 0. Upon determining that the number of virtual voices is greater than 0 (YES in S032), the CPU 11 executes a virtual voice initialization process (S033) and a variation depth setting process (S034). If it is determined that the number of virtual voices is not greater than 0 (NO in S032), the timbre selection process ends and the process proceeds to S04 (FIG. 5) of the main routine.

Figure 8:
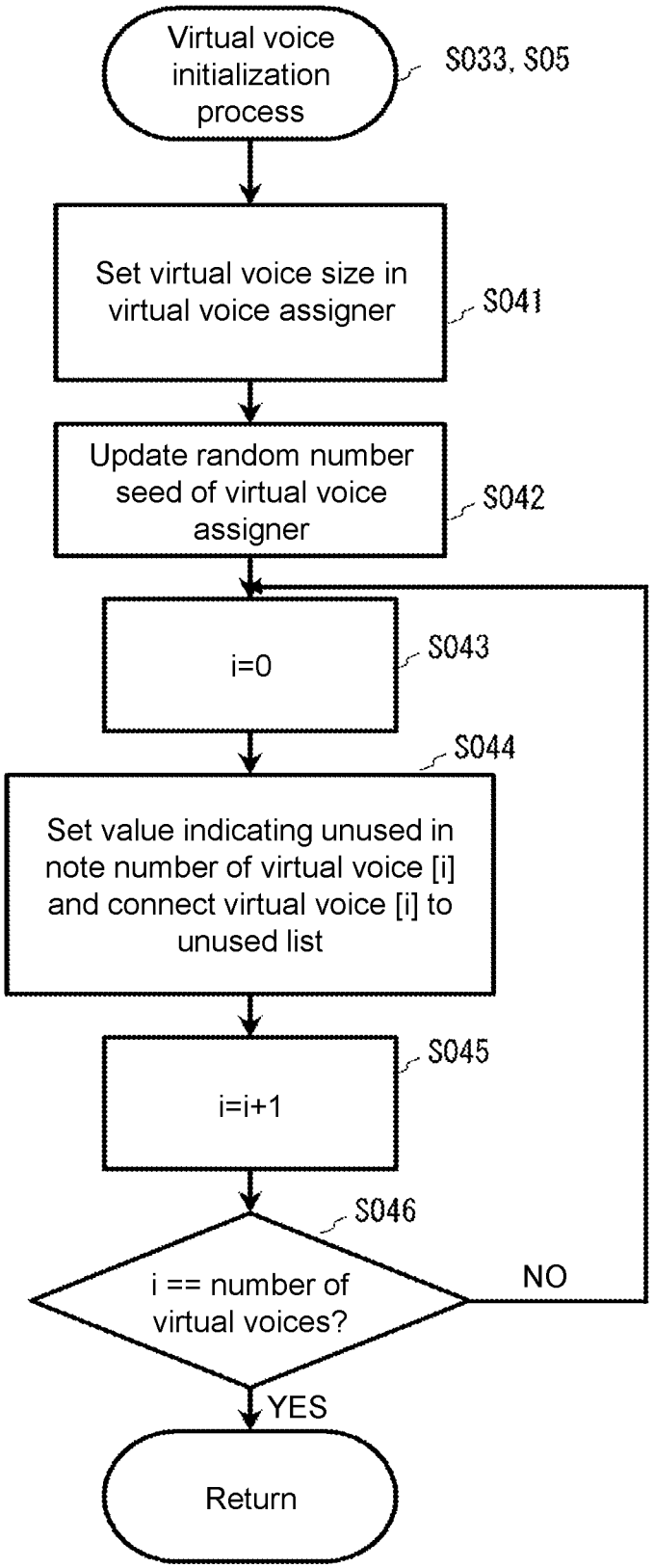
FIG. 8 is a flowchart showing an example of a subroutine of a virtual voice initialization process.

FIG. 8 is a flowchart showing an example of a subroutine of the virtual voice initialization process. In S041, the CPU 11 sets a virtual voice size (the number of virtual voices) in the virtual voice assigner according to the user's input. In S042, the CPU 11 updates a random number seed held in the virtual voice assigner.

In S043, the CPU 11 sets the value of a variable i indicating a virtual voice to 0. In S044, the CPU 11 sets a value indicating "unused" as the note number of an i-th virtual voice [i] and performs a process of connecting (registering) the i-th virtual voice [i] to (in) an unused virtual voice list. In S045, the CPU 11 increments the value of i. In S046, the CPU 11 determines whether or not the value of i has reached the number of virtual voices. Here, if the value of i has not reached the number of virtual voices (NO in S046), the process returns to S044. On the other hand, if the value of i has reached the number of virtual voices (YES in S046), the subroutine of the virtual voice initialization process ends and the process proceeds to the variation depth setting process (S034).

When the number of virtual voices has changed due to timbre selection, the virtual voice initialization process is performed as described above. In the virtual voice initialization process, a random number seed of the virtual voice assigner is updated and the variation value of the pitch of each virtual voice is calculated and updated.

Figure 9:
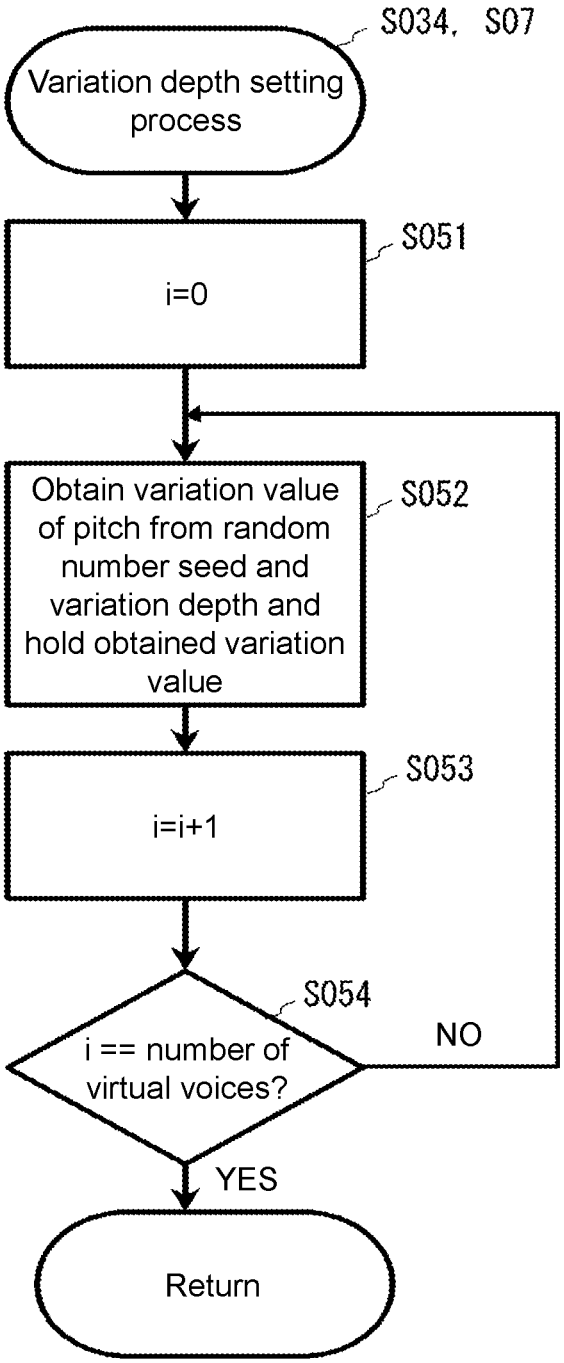
FIG. 9 is a flowchart showing an example of a subroutine of a variation depth setting process.

FIG. 9 is a flowchart showing an example of a subroutine of the variation depth setting process. In S051, the CPU 11 sets the value of the variable i indicating the virtual voice to 0. In S052, the CPU 11 obtains and holds (stores) a variation value of the pitch from the random number seed and the variation depth.

In S053, the CPU 11 increments the value of i. In S054, the CPU 11 determines whether or not the value of i has reached the number of virtual voices. Here, if the value of i has not reached the number of virtual voices (NO in S054), the process returns to S052. If the value of i has reached the number of virtual voices (YES in S054), the subroutine of the variation depth setting process ends and the process proceeds to S04 of the main routine.

When the variation depth has changed due to change of the timbre, the variation value of the pitch of each virtual voice is calculated and updated from the random number seed set in the virtual voice assigner as described above.

Returning to FIG. 5, in S04, the CPU 11 determines whether or not a request to change a virtual voice size (the number of virtual voices) has been input. If it is determined that this change request has been input (YES in S04), the process proceeds to S05 to perform the virtual voice initialization process (FIG. 8), and if not (NO in S04), the process proceeds to S06. In S05, the processes of S041 to S046 described above are performed.

In S06, the CPU 11 determines whether or not a variation depth change request has been input. If it is determined that this change request has been input (YES in S06), the process proceeds to S07 to perform the variation depth change process (FIG. 9), and if not (NO in S06), the process proceeds to S08. In S07, the processes of S051 to S054 described above are performed.

In S08, the CPU 11 determines the presence/absence of a key depression using the keyboard 13. If it is determined that there is a key depression (YES in S08), a subroutine of a key depression process (S09) is performed, and if not (NO in S08), the process proceeds to S10.

Figure 10:
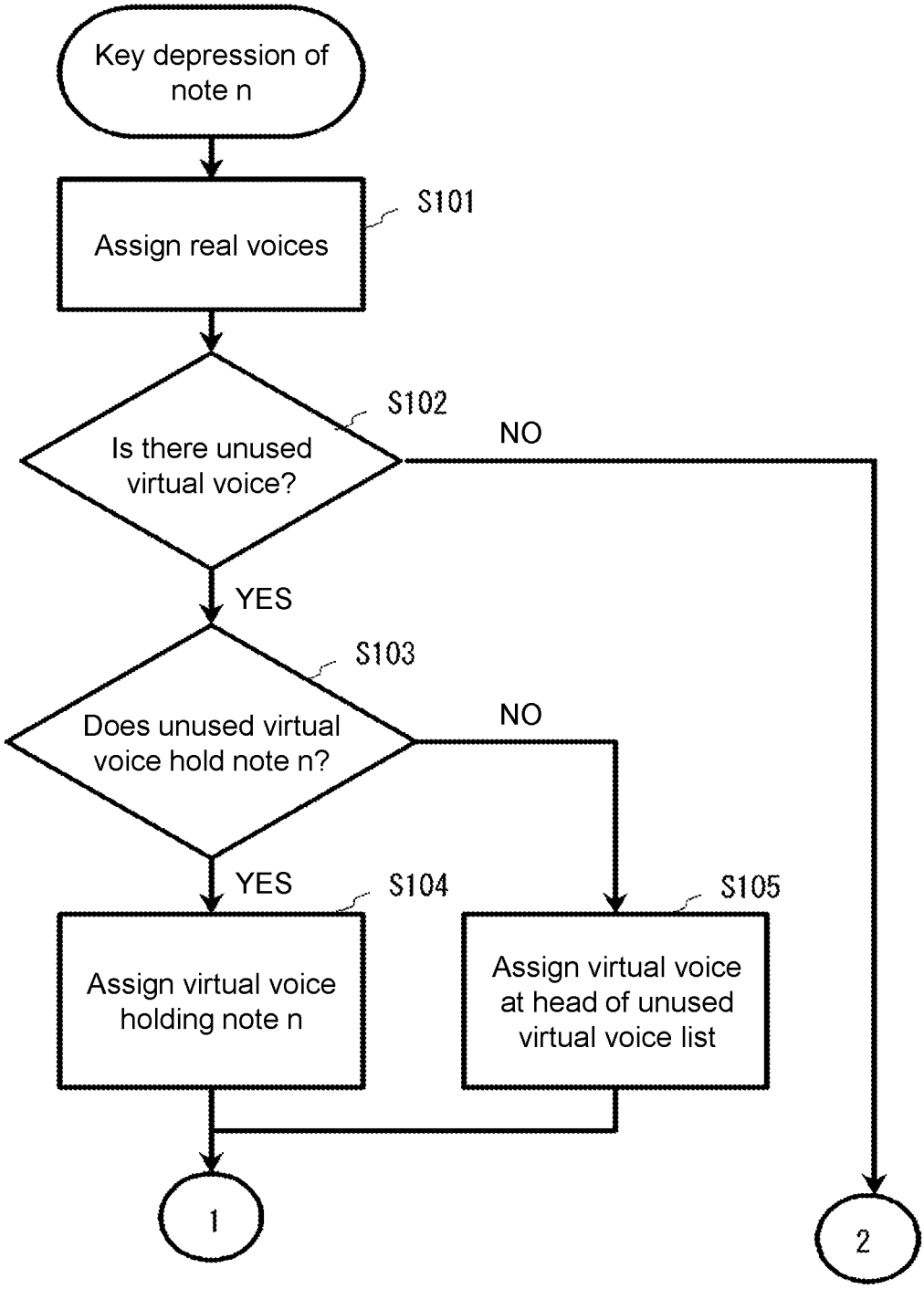
FIG. 10 is a flowchart showing an example of a subroutine of a key depression process.
Figure 11:
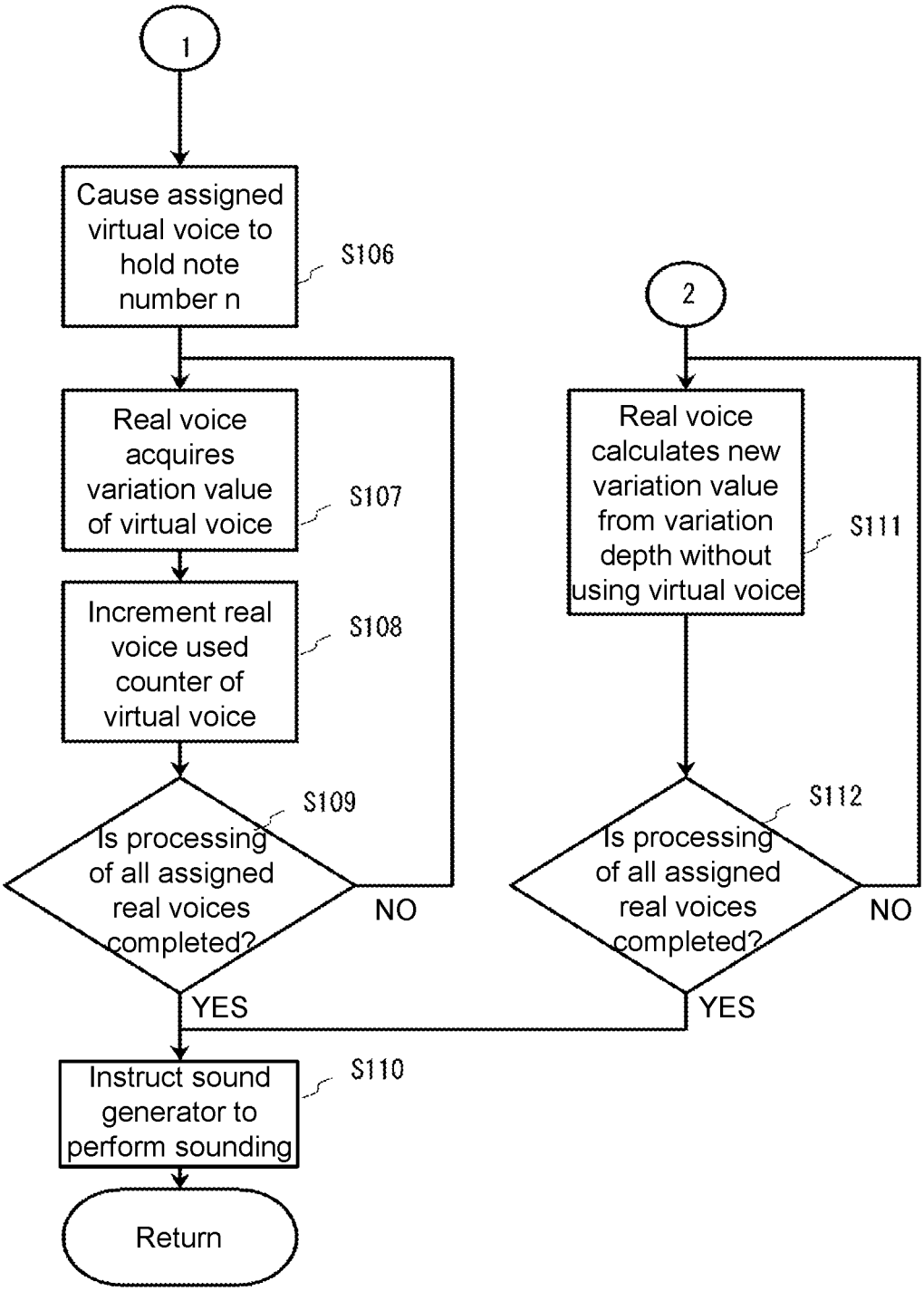
FIG. 11 is a flowchart showing an example of a subroutine of the key depression process.

FIGS. 10 and 11 are flowcharts showing an example of a subroutine of the key depression process. In the key depression process, real voices are assigned, a virtual voice is assigned if the number of virtual voices is not 0, and the real voices are sounded. At the start of the process of FIG. 10, parts and timbre data for sounding simulated voices of the analog synthesizer have already been selected by the user, and depression of a key of the keyboard 13 causes sounding to be performed based on the timbre data of a set part.

In S101, the CPU 11 identifies the depressed key (the key of a note number "N") and assigns one or more real voices for the identified key of the note number "N" (note N) in the timbre data (acquires information on real voices corresponding to the identified key).

In S102, the CPU 11 determines whether or not there is an unused virtual voice associated with the part. This processing is performed by determining whether or not there is a virtual voice registered in an unused virtual voice list corresponding to the part (timbre data).

Figure 12:
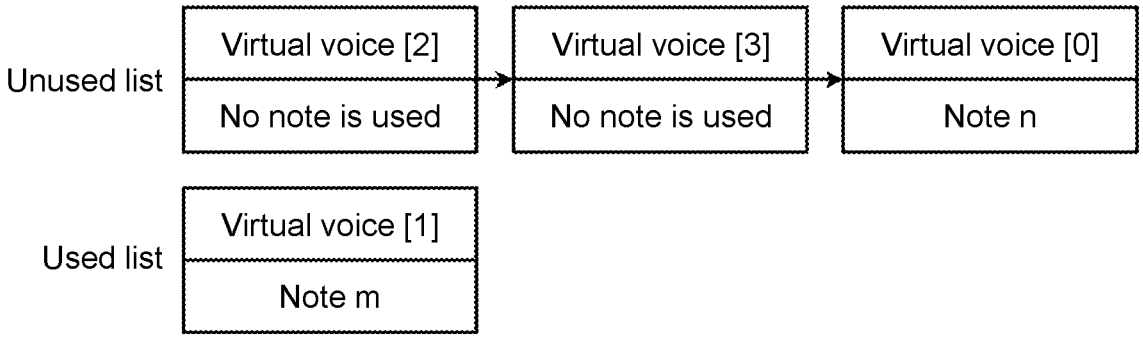
FIG. 12 is a diagram schematically showing an unused virtual voice list and a used virtual voice list.

FIG. 12 is a diagram schematically showing an unused virtual voice list (hereinafter referred to as an "unused list") and a used virtual voice list (hereinafter referred to as a "used list"). The unused list and the used list are prepared for each part. The unused list and the used list is used to manage used and unused states of a predetermined number of virtual voices prepared for one part. In the present embodiment, up to eight virtual voices are prepared for one part and four virtual voices among them are used (the number of virtual voices=4).

The identifiers (numbers) of unused virtual voices among the predetermined number of virtual voices are registered in the unused list. On the other hand, the identifiers (numbers)

of used virtual voices are registered in the used list. The identifier of a virtual voice is managed in combination with information indicating whether or not a corresponding note (key) is used.

The example of FIG. 12 shows a state in which four virtual voices ([0] to [3]) are set for one part, three of the four are registered in the unused list, and the remaining one (the virtual voice [1]) is registered in the used list. The number of the virtual voice in the used list is managed in combination with the number of a note in use, and the number of each virtual voice in the unused list is managed in combination with the number of a note which has been used in the past (a note which has triggered assignment in the past). When there is no corresponding note (there is no note that has ever been used in the past), the number of the virtual voice is managed in combination with information indicating that "no note is used."

If it is determined in S102 that there is an unused virtual voice by referring to the unused list (YES in S102), the process proceeds to S103, and if it is determined otherwise (NO in S102), the process proceeds to S111 (FIG. 11).

In S103, the CPU 11 determines whether or not there is a virtual voice managed in combination with the note number "N" (a virtual voice holding the note number "N") among the virtual voices registered in the unused list. If it is determined that there is a virtual voice holding the note number "N" (YES in S103), the process proceeds to S104, and if not (NO in S103), the process proceeds to S105.

If the process proceeds to S104, the CPU 11 (operating as the virtual voice assigner) assigns the virtual voice holding the note number "N" and proceeds to S106. If the process proceeds to S105, the CPU 11 operating as the virtual voice assigner assigns a virtual voice at the head of the unused list and proceeds to S106.

In S106, the CPU 11 causes the assigned virtual voice to hold the note number "N". That is, the CPU 11 registers, in the used list, information of the assigned virtual voice which includes a combination of the number of the assigned virtual voice and the note number "N."

In S107, a reproduction circuit corresponding to a real voice acquires a variation value of the virtual voice (a variation value of the pitch in the present embodiment). That is, the CPU 11 acquires a variation value corresponding to a real voice corresponding to the note "N" from information of a virtual voice included in information of the real voice.

In S108, the CPU 11 increments (by 1) the value of a counter indicating the number of used real voices included in the information of the virtual voice that has been referenced in S107. In S109, the CPU 11 determines whether or not acquisition of variation values for all assigned real voices (corresponding to the note N) is completed.

If it is determined in S109 that acquisition of variation values for all real voices is not completed (NO in S109), the process returns to S107. On the other hand, if it is determined that acquisition of variation values for all real voices is completed, the process proceeds to S110. In S110, the CPU 11 instructs the sound generator 14 to perform sounding. The sound generator 14 starts a sounding process using a reproduction circuit corresponding to the assigned real voice.

If the process proceeds from S102 to S111, that is, if it is determined that there is no unused virtual voice, no virtual voice is used. That is, the CPU 11 does not use a variation value of a virtual voice for sounding and performs a process of calculating a new variation value from information indicating the variation depth and performing update with the new variation value. Here, since no virtual voice is assigned, a value indicating that no virtual voice is used is set as a virtual voice that is referenced by the real voice. Such a process is performed for all assigned real voices (S112), and if the process of S112 is completed, the process proceeds to S110. A virtual voice with low priority (a virtual voice with a low volume or a long time elapsed from the start of sounding) may be muted and the virtual voice may be assigned if it is determined in S102 that there is no unused virtual voice. Also, no virtual voice and no real voices may be assigned and the key depression process may be terminated if it is determined in S102 that there is no unused virtual voice. In this case, sounding corresponding to the key depression is not performed.

Returning to FIG. 5, after the key depression process, the CPU 11 monitors release of the depressed key (S10), and if no key release is detected (NO in S10), the process proceeds to S12. On the other hand, if a key release is detected (YES in S10), the process proceeds to S11 and a subroutine of the key release process is performed.

Figure 13:
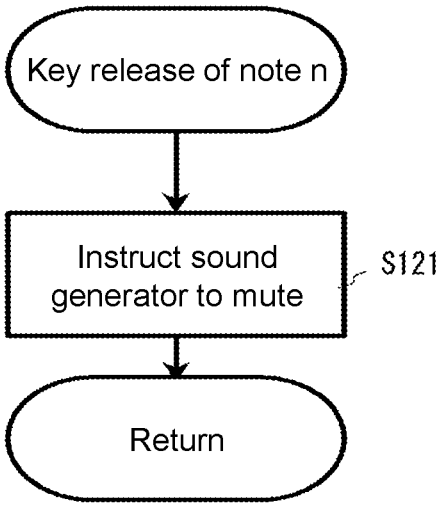
FIG. 13 is a flowchart showing an example of a subroutine of a key release process.

FIG. 13 is a flowchart showing an example of the subroutine of the key release process. In S121, the CPU 11 instructs the sound generator 14 to mute. The sound generator 14 starts attenuating a real voice corresponding to the released key (note N) and releases the real voice when attenuation of the real voice has ended.

Returning to FIG. 5, in S12, it is determined whether or not attenuation of a real voice has ended. If it is determined that attenuation of a real voice has ended (YES in S12), a subroutine of the attenuation termination process (S13) is performed, and if not (NO in S12), the process proceeds to S14.

Figure 14:
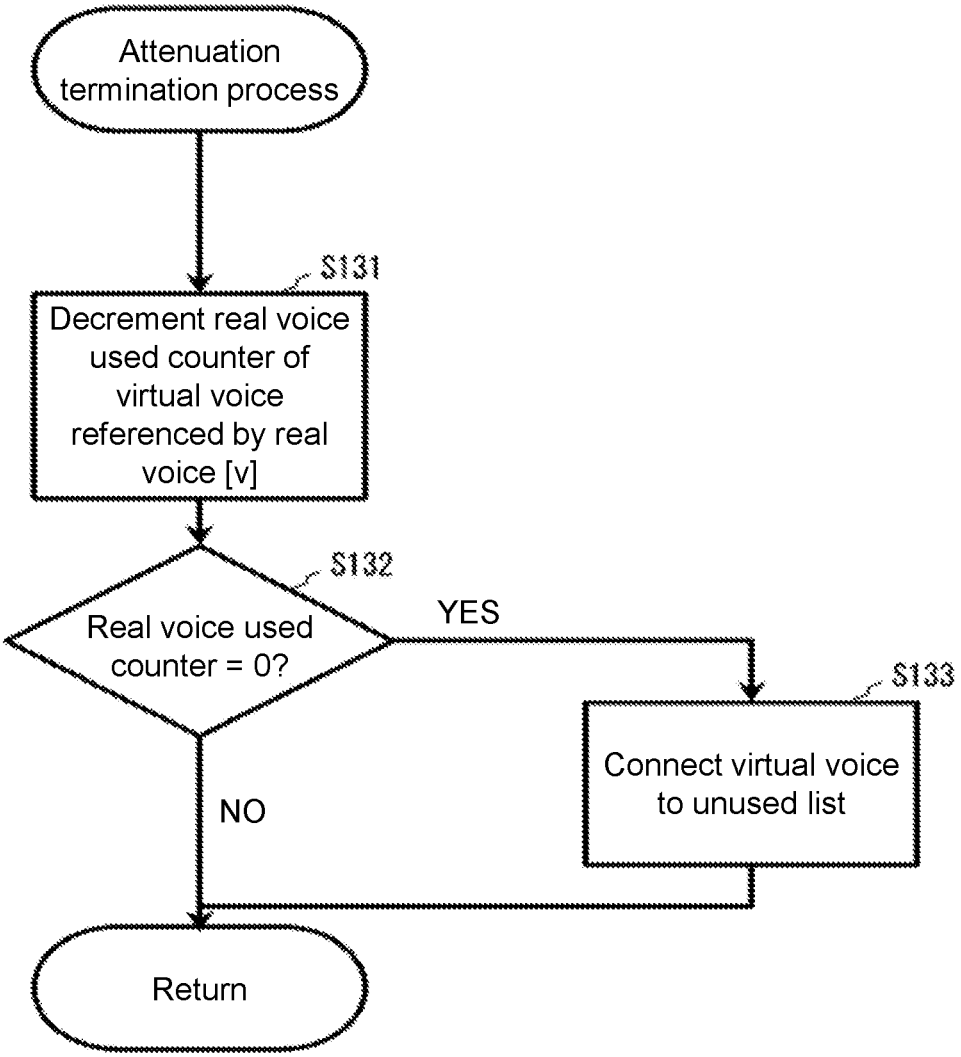
FIG. 14 is a flowchart showing an example of a subroutine of an attenuation termination process.

FIG. 14 is a flowchart showing an example of the subroutine of the attenuation termination process. In step S131, the counter of the number of real voices in the information of the virtual voice which the terminated real voice has referenced for its variation value is decremented (by 1). In S132, it is determined whether or not the counter value has become 0 due to the decrement. If it is determined that the count value has become 0 (YES in S132), the information of the virtual voice is registered in the unused list (that is, the virtual voice is released) (S133) and the subroutine of the attenuation termination process ends. If it is determined that the count value has not become 0 (NO in S132), the subroutine of the attenuation termination process ends.

In S14, a process of changing the timbre according to operation of a performance operator (the keyboard 13) (aftertouch), a process of changing various settings according to operation of the input device 18, and the like are performed as other processes. After the end of S14, the process returns to S02. The main routine ends, for example, when the electronic musical instrument 10 is powered off.

<Voice Assignment>

Details of voice assignment processing in the above process will be described. When the key on the keyboard of the electronic musical instrument 10 is depressed, the real voice assigner (CPU 11) assigns a real voice corresponding to the note for sounding of the real voice. Here, an unused real voice is preferentially assigned. If there is no unused real voice, a real voice with low priority (a real voice with a low volume or a long time elapsed from the start of sounding) among real voices in use is muted and reassigned for the new sounding.

If the parameter indicating the number of virtual voices is 0 (if the number of virtual voices is 0), no virtual voice is used. For the timbre of a part for an instrument other than the analog synthesizer such as a piano or a rhythm the parameter indicating the number of virtual voices is set to 0. In the key depression process and the key release process in this case, no processing relating to a virtual voice is performed.

On the other hand, if the parameter indicating the number of virtual voices is not 0, a virtual voice is assigned. If there is a virtual voice that holds the same note number as the depressed note number in the unused list, the virtual voice is assigned, and, if not, a virtual voice (with highest priority) registered at the head of the unused list is assigned as described above.

If there is no virtual voice registered in the unused list, that is, if there is no unused virtual voice, no virtual voice is assigned.

If a virtual voice is assigned, the real voice holds the number of the virtual voice. That is, the virtual voice assigner supplies the number of the virtual voice to a reproduction circuit that performs reproduction processing using information of the real voice. The reproduction circuit accesses information of the virtual voice by using the number of the virtual voice, acquires a variation value (for example, a variation value of the pitch) corresponding to the real voice from the information of the virtual voice, and reflects the acquired variation value in the corresponding parameter of the real voice. As a result, a musical sound having variations in pitch like the analog synthesizer is generated and output.

When a virtual voice has been assigned, the depressed note number is stored in information of the virtual voice. The virtual voice increments its real voice counter when a variation value is acquired from a real voice.

When the virtual voice is not assigned, a new random value corresponding to the variation depth is acquired and reflected in the corresponding parameter of the real voice. Also, when the virtual voice is not assigned, rather than not assigning a virtual voice, a voice with a long time elapsed from the start of sounding may be searched for in virtual voices in use and may be reassigned for the new sounding (in which case a real voice corresponding to the virtual voice is muted).

<Voice Release>

Details of voice release in the above process will now be described. A real voice starts attenuating when a corresponding key is released and stops operating and is brought into an unused state when the attenuation has ended. Here, if the real voice has a virtual voice referenced for its variation value, the real voice notifies the virtual voice of its termination. The virtual voice which has been notified of termination of the real voice decrements the real voice counter and is connected to the tail of the unused list when the real voice counter has reached 0.

<Specific Example of Voice Assignment>

A specific example of voice assignment will be described below. The specific example will be described for the case where the number of real voices is 128 and the number of virtual voices is 4 as an example. As shown in FIG. 7, timbre data has the number of virtual voices and a variation depth. In the specific example, 4 is set as the number of virtual voices. It is also assumed that the timbre is formed of partials using two oscillators (real voices).

The number of virtual voices and the variation depth are set in the virtual voice assigner. Through initialization of virtual voices, a number of information blocks of virtual voices corresponding to the number of virtual voices are set in an unused list. In the unused list, the information blocks are linked in descending order of priority.

FIG. 15 is an explanatory diagram of an unused list, a used list, and a keyboard immediately after initialization. In the unused list, information blocks (information sets) relating to virtual voices [0] to [3] are registered in order of priority, starting from the head. Priority numbers are in ascending order from the highest priority. The blocks are linked (connected) in order of priority. Each block has a storage area for a note number. Information indicating that no note is used is stored in each block at the time immediately after initialization. At this time, there is no virtual voice block registered in the used list because there is no virtual voice in use. The keyboard 13 is exemplified by white and black keys for one octave.

Since the number of virtual voices has been set (updated), the virtual voice assigner updates the random number seed (held in the virtual voice assigner). At this time, the virtual voice assigner calculates and holds a number of variation values (for the virtual voices [0] to [3]) (variation values of the pitch in the present embodiment) corresponding to the number of virtual voices through calculation of random number×variation depth. The timbre used in this example is formed using two oscillators (OSC1, OSC2). Therefore, the two variation values 1 and 2 are held separately (the variation values 1 and 2 may have the same value depending on random numbers). The variation values preferably differ between the virtual voices.

Figure 16:
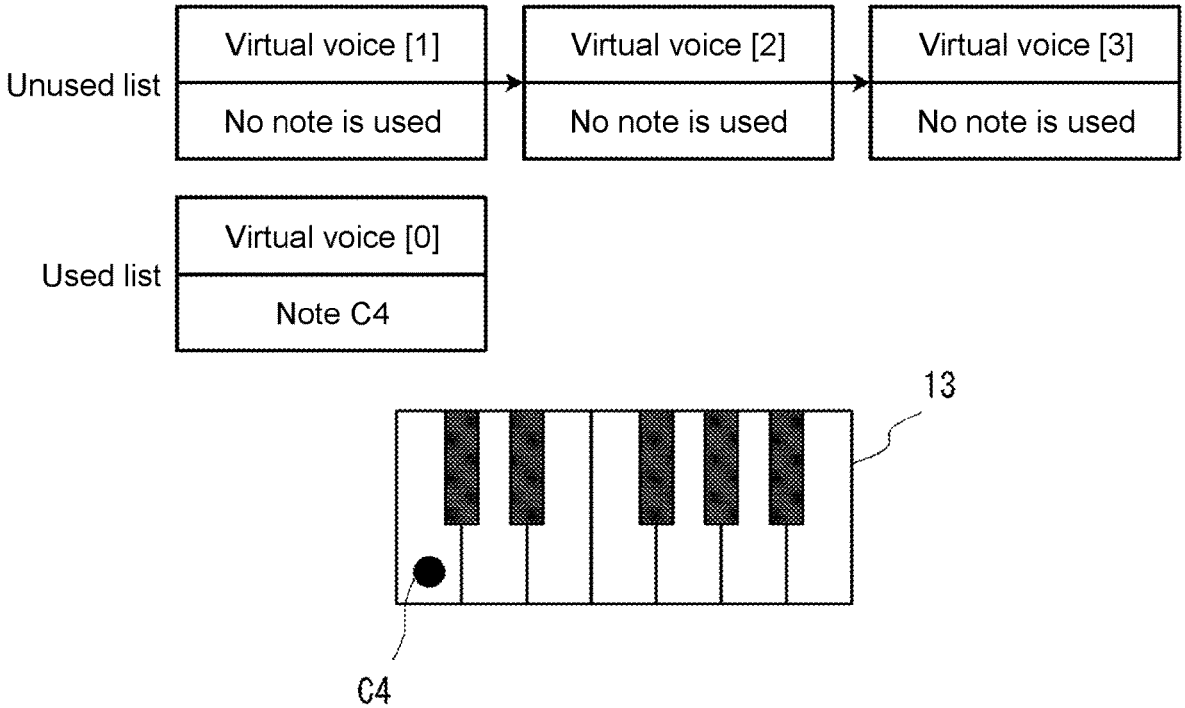
FIG. 16 is an explanatory diagram of processing when the key of a note number "C4" is depressed in the specific example.
Figure 17:
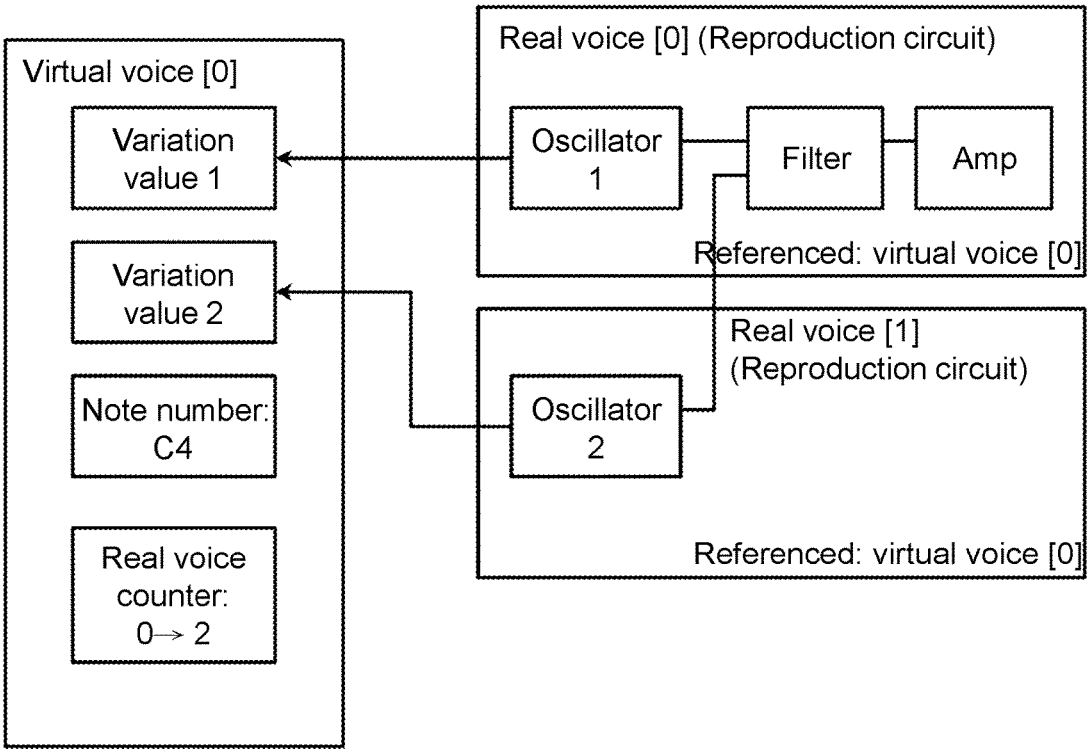
FIG. 17 is an explanatory diagram of processing when the key of the note number "C4" is depressed in the specific example.

Thereafter, it is assumed that the key of a note "C4" is depressed. FIGS. 16 and 17 are explanatory diagrams of processing when the key of the note C4 is depressed. On the keyboard 13 shown in FIG. 16, the key marked with a black circle is that of the note C4. In this specific example, two oscillators (OSC1 and OSC2) are used. Therefore, two real voices (for example, real voices [0] and [1]) are assigned corresponding to the key depression of C4. Here, the virtual voice assigner assigns one virtual voice.

Therefore, a virtual voice block holding the note number C4 is searched for, starting from the head of the unused list. Here, note numbers of all blocks are values indicating that no note is used, such that none of them match C4. In this case, the virtual voice assigner registers the note number C4 in the block at the head of the unused list and moves the block from the unused list to the used list. This brings the states of the unused list and the used list into those shown in FIG. 16.

FIG. 17 shows the relationship between the real voices [0] and [1] and the virtual voice [0] when the key of the note C4 is depressed. As shown in FIG. 17, reproduction circuits that perform a sounding process for the real voices [0] and [1] receive the virtual voice number [0] supplied from the virtual voice assigner and accesses information of the virtual voice [0]. The information of the virtual voice [0] is stored in the storage device 12 and includes previously calculated variation values 1 and 2 of the pitch. The information of the virtual voice [0] also includes information indicating the note number C4.

The reproduction circuit corresponding to the real voice [0] acquires the variation value 1 of the pitch and reflects it in the sounding parameter. The reproduction circuit corresponding to the real voice [1] acquires the variation value 2 of the pitch and reflects it in the sounding parameter. These reproduction circuits perform a sounding process with the variation values 1 and 2 reflected. Each of the real voices [0] and [1] holds (stores) the referenced virtual voice number [0].

The information of the virtual voice [0] has a real voice counter and the value of the real voice counter is incremented each time a variation value is acquired from the real voice. Here, the count value becomes 0→2 since the real voices [0] and [1] acquire the variation values 1 and 2.

Figure 18:
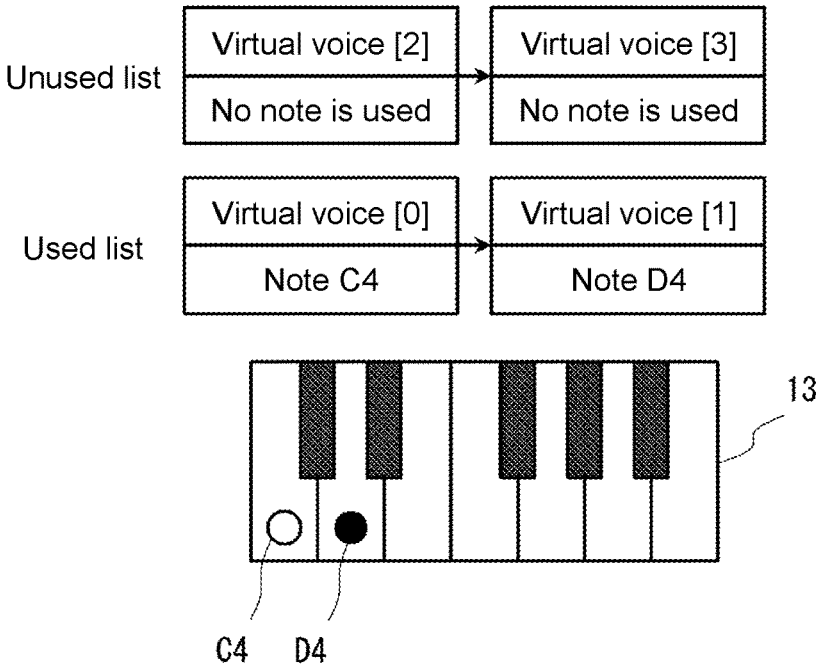
FIG. 18 is an explanatory diagram of processing when the key of a note number "D4" is depressed in the specific example.
Figure 19:
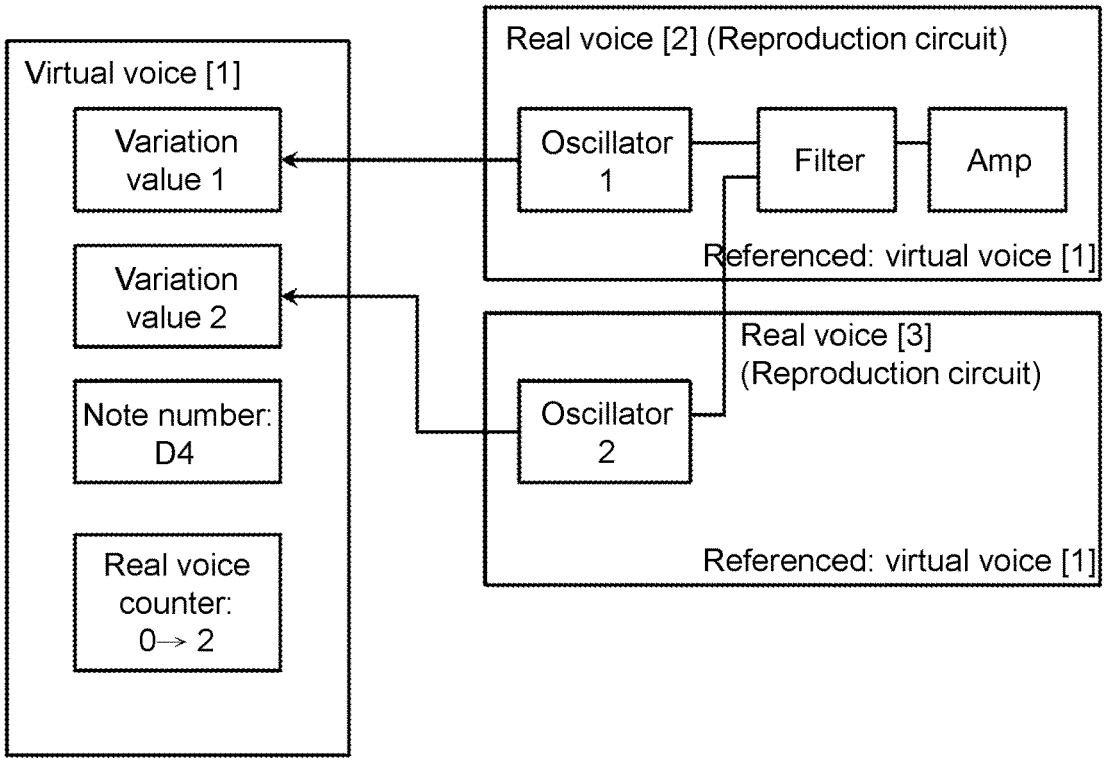
FIG. 19 is an explanatory diagram of processing when the key of the note number "D4" is depressed in the specific example.

Thereafter, it is assumed that the key of the note "D4" is depressed subsequent to the note C4. FIGS. 18 and 19 are explanatory diagrams of processing when the key of the note D4 is depressed in the specific example. On the keyboard 13 shown in FIG. 18, the key marked with a white circle is that of the note C4 and the key marked with a black circle is that of the note D4.

In this specific example, two real voices [2] and [3] are assigned because two oscillators (OSC1 and 2) are used. The virtual voice assigner assigns one virtual voice corresponding to the real voices [2] and [3]. The virtual voice assigner refers to the unused list (in the state in FIG. 16) and searches for a virtual voice block storing the note D4. However, no block storing D4 is found. Therefore, the virtual voice assigner registers the note number D4 in the block of the virtual voice [1] at the head of the unused list and moves the block to the used list (FIG. 18). At this time, the block of the virtual voice [1] is registered immediately subsequent to the previously registered virtual voice [0]. On the other hand, the unused list is brought into a state in which the blocks of virtual voices [2] and [3] are connected and registered.

As shown in FIG. 19, reproduction circuits that perform a sounding process for the real voices [2] and [3] receive the virtual voice number [1] supplied from the virtual voice assigner and accesses information of the virtual voice [1]. For example, the information of the virtual voice [1] includes previously calculated variation values 1 and 2 of the pitch. The information of the virtual voice [1] also includes information indicating the note number D4.

The reproduction circuit corresponding to the real voice [2] acquires the variation value 1 of the pitch and reflects it in the sounding parameter. The reproduction circuit corresponding to the real voice [3] acquires the variation value 2 of the pitch and reflects it in the sounding parameter. These reproduction circuits perform a sounding process with the variation values 1 and 2 reflected. The reproduction circuits corresponding to the real voices [2] and [3] hold (store) the referenced virtual voice number [1]. The value of the real voice counter included in the information of the virtual voice [1] becomes 0→2 as the real voices [2] and [3] acquire the variation values 1 and 2.

Figure 20:
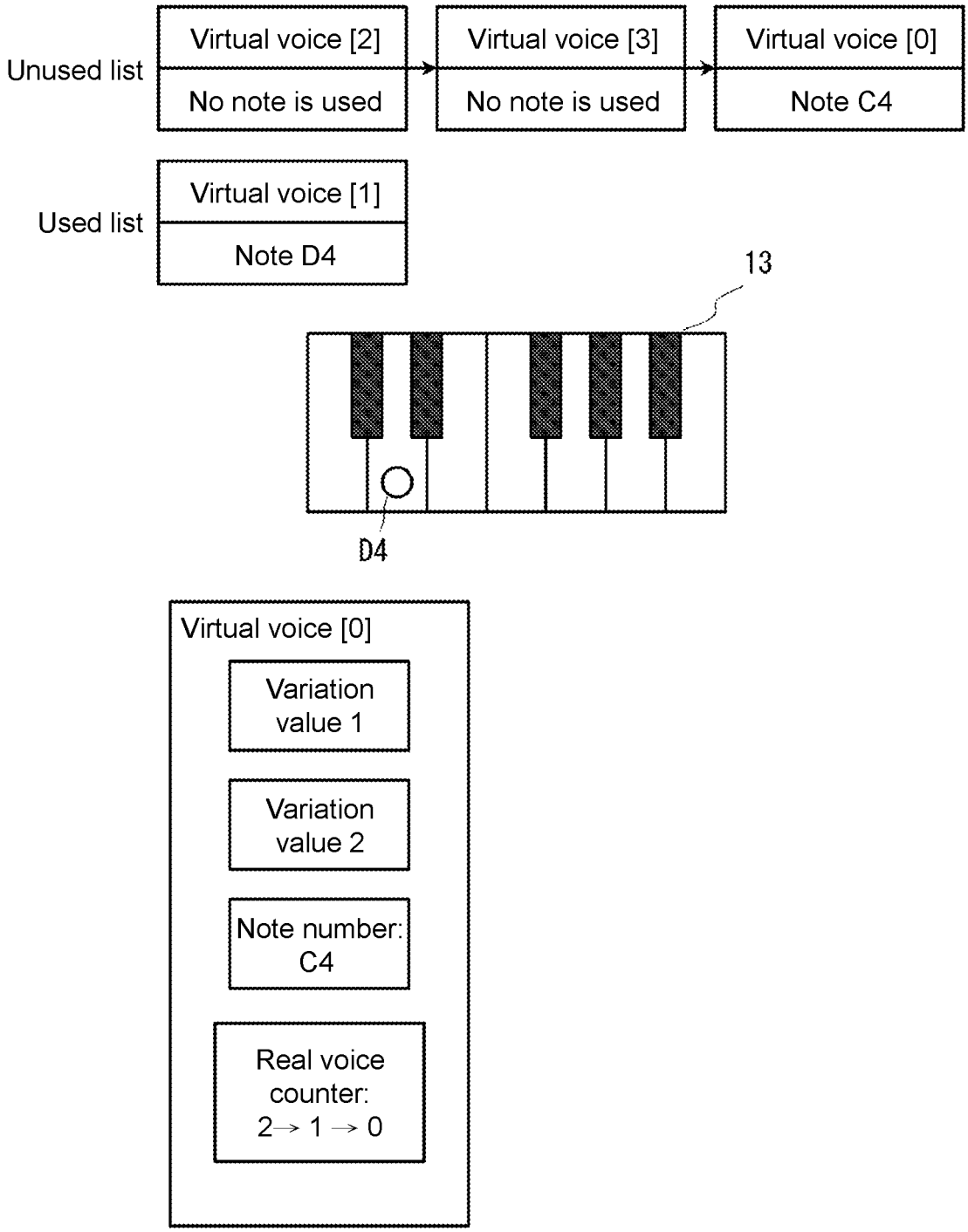
FIG. 20 is an explanatory diagram of processing when the key of the note number "C4" is released in the specific example.

Thereafter, it is assumed that the key of the note C4 is released with the note D4 being depressed. FIG. 20 is an explanatory diagram of processing when the key of the note C4 is released in the specific example. On the keyboard 13 shown in FIG. 20, the key marked with a white circle is that of the note D4.

Detection of the key release of the note C4 triggers the start of attenuation of the real voices [0] and [1]. When the attenuation of the real voice [0] has ended, the CPU 11 notifies the virtual voice assigner or an entity responsible for managing the information of the virtual voice [0] that the real voice [0] has ended. Thereby, the count value of the real voice counter in the information of the virtual voice [0] is decremented such that it becomes 2→1.

Further, when the attenuation of the real voice [1] has ended, the CPU 11 notifies the virtual voice assigner or the entity responsible for managing the information of the virtual voice [0] that the real voice [1] has ended. Thereby, the count value of the real voice counter in the information of the virtual voice [0] is decremented such that it becomes 1→0. When the count value has reached 0, the block of the virtual voice [0] is moved from the used list to the unused list. At this time, this block is registered at the end (tail) of the unused list while retaining the note number C4 and is linked to the block of the virtual voice [3] that was at the tail until then. This brings the unused list into a state in which the virtual voices are connected in the order of [2], [3], and [0].

Figure 21:
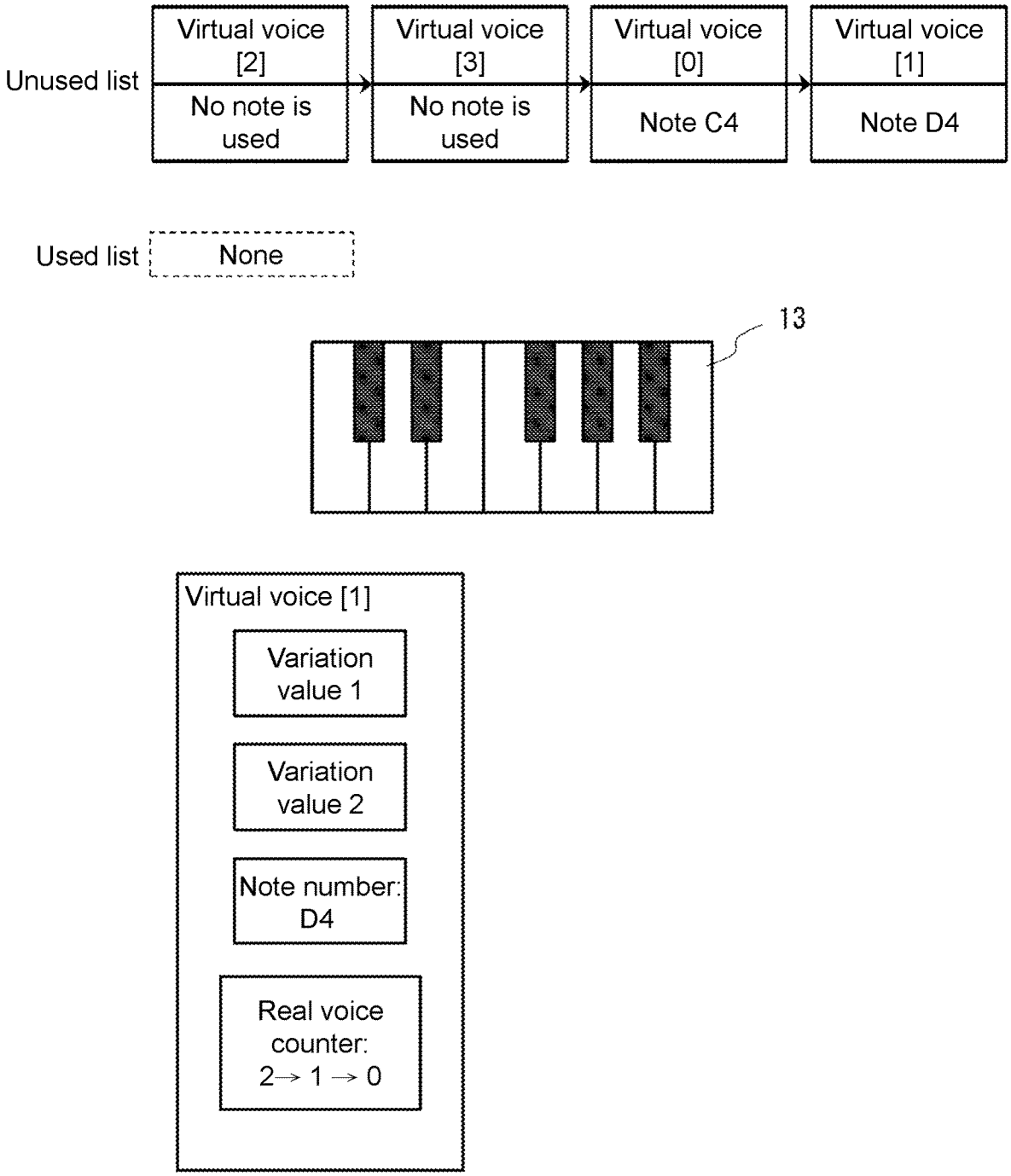
FIG. 21 is an explanatory diagram of processing when the key of the note number "D4" is released in the specific example.

Thereafter, it is assumed that the key of the note D4 is released. FIG. 21 is an explanatory diagram of processing when the key of the note D4 is released in the specific example. In FIG. 21, no keys are being depressed due to the release of the note D4.

Detection of the key release of the note D4 triggers the start of attenuation of the real voices [2] and [3]. When the attenuation of the real voice [2] has ended, the CPU 11 notifies the virtual voice assigner or an entity responsible for managing the information of the virtual voice [1] that the real voice [2] has ended. Thereby, the count value of the real voice counter in the information of the virtual voice Ellis decremented to 1.

Further, when the attenuation of the real voice [3] has ended, the CPU 11 notifies the virtual voice assigner or the entity responsible for managing the information of the virtual voice [1] that the real voice [3] has ended. Thereby, the count value of the real voice counter in the information of the virtual voice [1] is decremented to 0. When the count value has reached 0, the block of the virtual voice [1] is moved from the used list to the unused list. At this time, this block is registered at the end (tail) of the unused list while retaining the note number D4 and is linked to the block of the virtual voice [3] that was at the tail until then. This brings the unused list into a state in which the virtual voices are connected in the order of [2], [3], [0], and [1].

Figure 22:
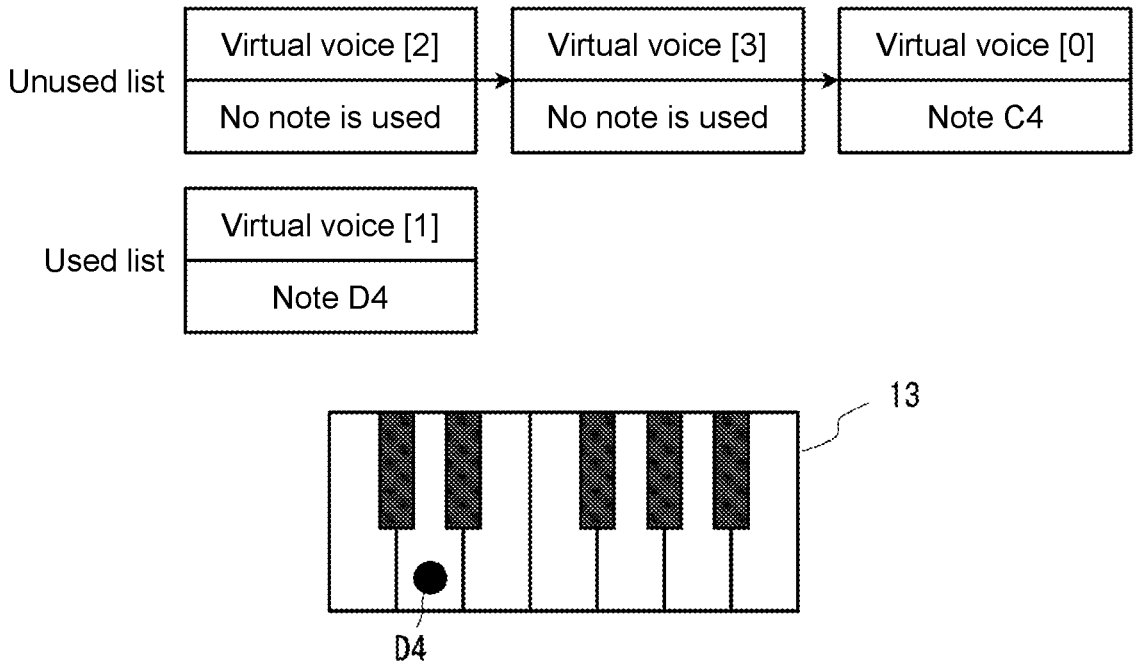
FIG. 22 is an explanatory diagram of processing when the key of the note number "D4" is depressed again in the specific example.

Thereafter, it is assumed that the key of the note D4 is depressed again. FIG. 22 is an explanatory diagram of processing when the key of the note D4 is depressed again in the specific example. On the keyboard 13 in FIG. 22, the key marked with a black circle is that of the note D4.

Two real voices (for example, the real voices [2] and [3]) corresponding to the oscillators are assigned due to the key depression of the note D4. The real voices [2] and [3] are not necessarily assigned at this time. If the key of the note C4 is released before the key of the note D4 is depressed again and the attenuation of the real voices [0] and [1] assigned by the key depression of the note C4 is completed, making the real voices [0] and [1] opened, then the real voices [0] and [1] are assigned. Also, if the keys of the note C4 and D4 are released before the key of the note D4 is depressed again, but the attenuation of the real voices [0] to [3] assigned to them is not completed, then real voice [4] and [5] are assigned. That is, which real voices are assigned change depending on the situation at that time.

The virtual voice assigner searches for a virtual voice block storing the note D4, starting from the head of the unused list. In the unused list shown in FIG. 22, note numbers stored in the head and second blocks are values indicating that no note is used and do not match D4. The note number of the third block from the head does not match D4 because it is C4. However, the note number of the fourth block from the head matches D4. Therefore, the block of the virtual voice [1], which is the fourth from the head, is acquired again and moved to the used list. The relationship between the real voices [2] and [3] and the virtual voice [1] is as shown in FIG. 19.

If after the key release of the note D4, the key of the note D4 is depressed again before the attenuation ends (the virtual voice [1] is released), the virtual voice [1] that has not been released may be taken over and used depending on the specifications of the analog synthesizer to be simulated. In such specifications, if the used list includes a virtual voice block holding the same note number as that of the depressed note when a virtual voice is to be assigned, the virtual voice of this virtual voice block is preferentially assigned. A new virtual voice block (for example, the virtual voice [2]) may also be reassigned for the key depression of the note D4 again.

Figure 23:
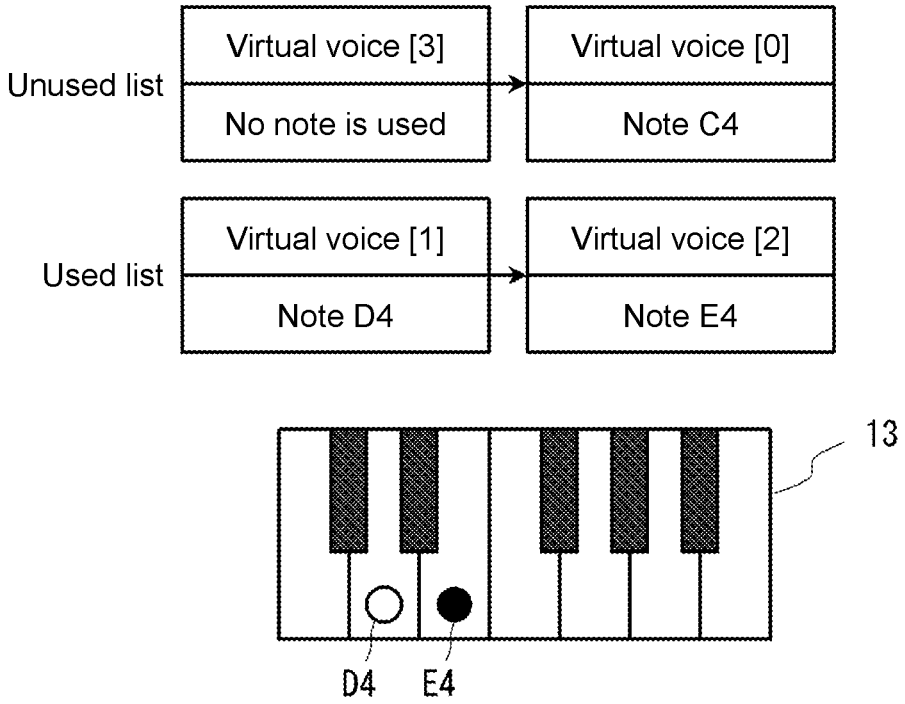
FIG. 23 is an explanatory diagram of processing when the key of a note number "E4" is depressed in the specific example.

Thereafter, it is assumed that the key of the note E4 is depressed before the key of D4 is released. FIG. 23 is an explanatory diagram of processing when the key of the note E4 is depressed in the specific example. On the keyboard 13 in FIG. 23, the key marked with a white circle is that of the note D4 and the key marked with a black circle is that of the note E4.

Two real voices (for example, real voices [4] and [5]) are assigned corresponding to the key depression of the note E4 because two oscillators are used. On the other hand, one virtual voice corresponding to the note E4 is assigned. Even if a virtual voice block storing the note E4 is searched for in the unused list (FIG. 22), no corresponding block is found. Therefore, the block of the virtual voice [2] at the head of the unused list is acquired. The note number "E4" is set in this block of the virtual voice [2] and the block is moved to the tail of the used list (FIG. 23).

Figure 24:
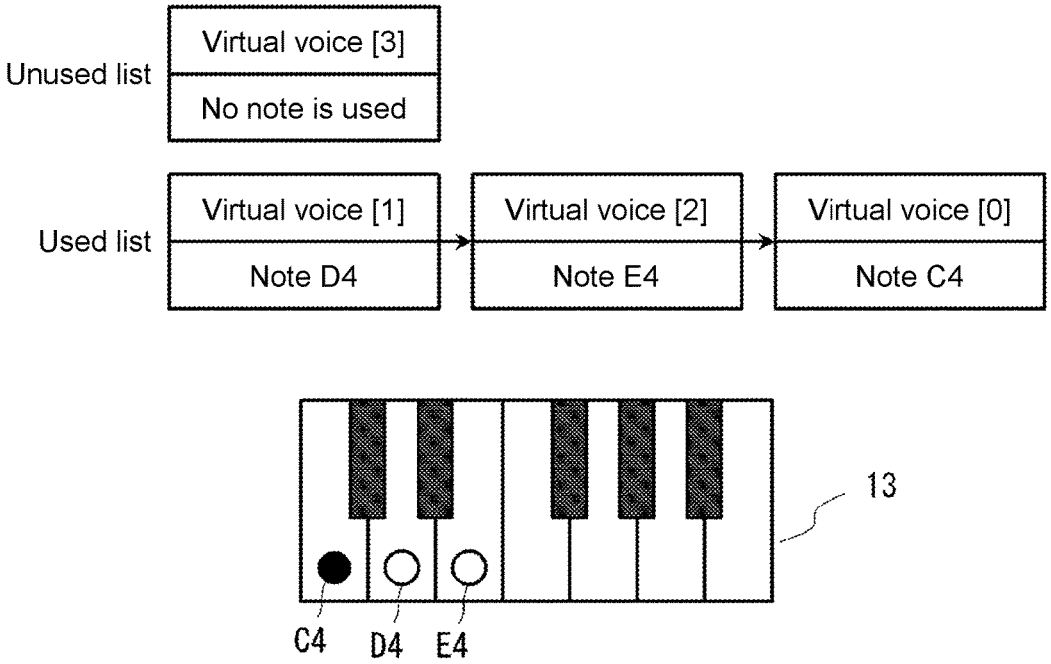
FIG. 24 is an explanatory diagram of processing when the key of the note number "C4" is depressed again in the specific example.

Thereafter, it is assumed that the key of the note C4 is depressed before the keys of D4 and E4 are released. FIG. 24 is an explanatory diagram of processing when the key of the note C4 is depressed before the keys of the notes D4 and E4 are released in the specific example.

Two real voices (for example, the real voices [0] and [1]) are assigned corresponding to the key depression of the note C4 and one virtual voice corresponding to these is assigned. At this time, a block storing C4 is searched for in the unused list (FIG. 23). Here, the block of the virtual block [0] storing C4 is registered in the unused list as the second from the head. Therefore, the block is moved to the tail of the used list (FIG. 24).

Figure 25:
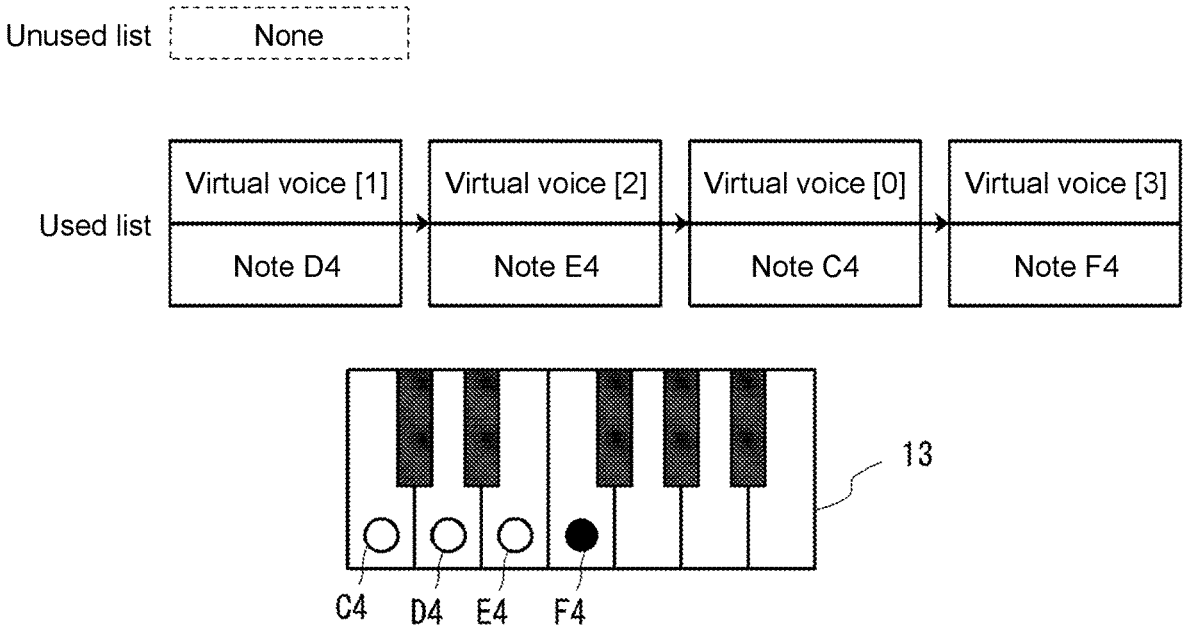
FIG. 25 is an explanatory diagram of processing when the key of a note number "F4" is depressed in the specific example.

Thereafter, it is assumed that the key of a note F4 is depressed before the keys of C4, D4, and E4 are released. FIG. 25 is an explanatory diagram of processing when the key of the note F4 is depressed before the keys of the notes C4, D4, and E4 are released in the specific example.

Two real voices (for example, real voices [6] and [7]) are assigned corresponding to the key depression of the note F4 and one virtual voice corresponding to these is assigned. At this time, because no block storing F4 is found in the unused list (FIG. 24), the note F4 is stored in the block at the head of the unused list and the block is moved to the tail of the used list (FIG. 25).

Thereafter, it is assumed that the key of a note G4 is depressed before the keys of C4, D4, E4, and F4 are released. Two real voices (real voices [8] and [9]) are assigned corresponding to the key depression of the note G4 and one virtual voice corresponding to these is attempted to be assigned. However, there is no virtual voice block in the unused list (FIG. 25). In this case, the real voices may be sounded without using a virtual voice.

However, in the present embodiment, the CPU 11 calculates new random number values for the real voices [8] and [9] using the information shown in FIG. 15, calculates the variation values 1 and 2 of the pitch from these random number values and the variation depth of the pitch, and supplies the calculated variation values 1 and 2 of the pitch to reproduction circuits for the real voices [8] and [9]. The reproduction circuits generate and output a simulated voice in which the variation values of the corresponding pitch are reflected. At this time, each of the real voices [8] and [9] holds a number indicating that no virtual voice is used as the number of a referenced virtual voice.

Figure 26:
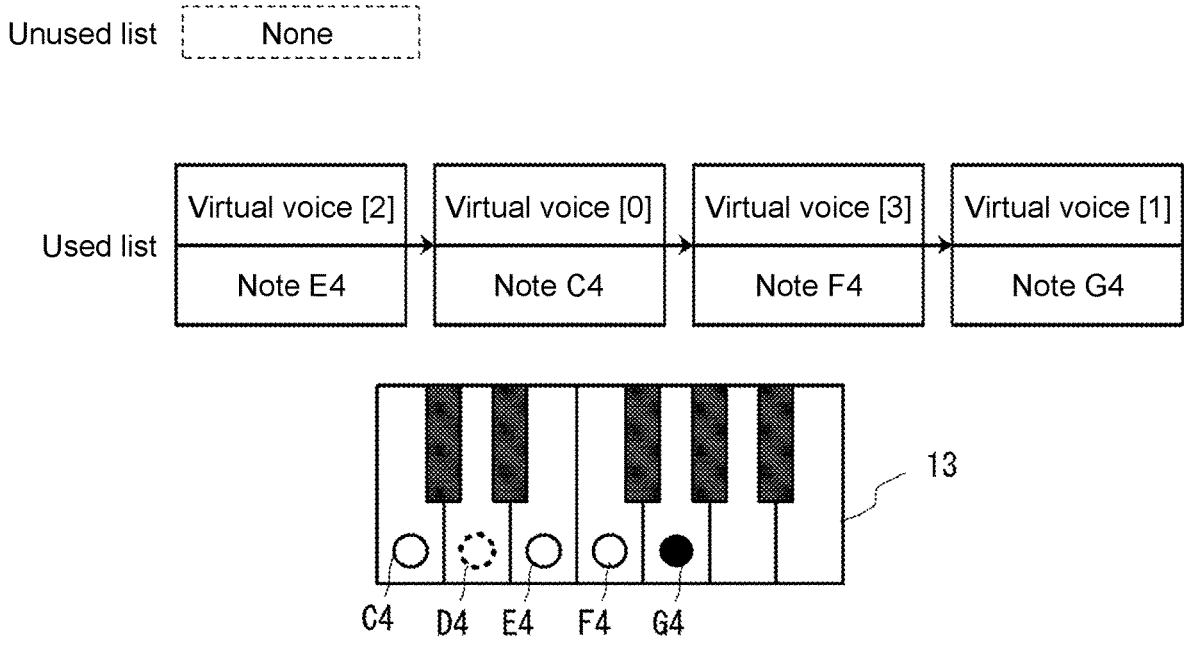
FIG. 26 is an explanatory diagram of processing when the key of a note number "G4" is depressed in the specific example.

In the above exemplary processing, it has been described that a process of sounding new real voices without muting a note being depressed is performed when a virtual voice cannot be acquired. However, the real voices [4] and [5] which reference a virtual voice with the longest time elapsed from the start of use among the virtual voices being used (the virtual voice [1] in this example (see FIG. 25)) is muted (see FIG. 26 where D4 is indicated by a dashed circle). Then, the note G4 may be registered in the block of the virtual voice [1] and the block may be moved to the tail of the used list (see FIG. 26).

The musical sound generation device and method according to the embodiment adopt a configuration in which a predetermined number of simulated voices determined based on the number of voices capable of being sounded of the analog synthesizer to be simulated are sounded for a part that has been set to sound simulated voices of the analog synthesizer, such that simulated voices close to those of an actual device are sounded. When a key (a performance operator) on the keyboard 13 which is associated with a part for simulated voices of the analog synthesizer is depressed (operated) with the part selected, the CPU 11 (a control device) performs the following process.

That is, the CPU 11 serving as the real voice assigner assigns sounding parameters of one or two or more real voices for sounding a virtual voice (simulated voice) corresponding to the depressed key (note) (sounding parameters of one or two or more voices forming a timbre of the analog synthesizer) to the sound generator 14 (the sound generation circuit). Further, the CPU 11 serving as the virtual voice assigner assigns an information set selected from a plurality of information sets of virtual voices to the sound generator 14. Each of the information sets of virtual voices includes variation values that apply variations to the sounding parameters of one or two or more voices.

The sound generator 14 performs a sounding process of one or two or more voices using the sounding parameters and the information set. As a result, it is possible to generate simulated voices of the analog synthesizer having variations in pitch or the like, that is, voices having the nuances of sound of the analog synthesizer.

<Modifications>

Figure 27:
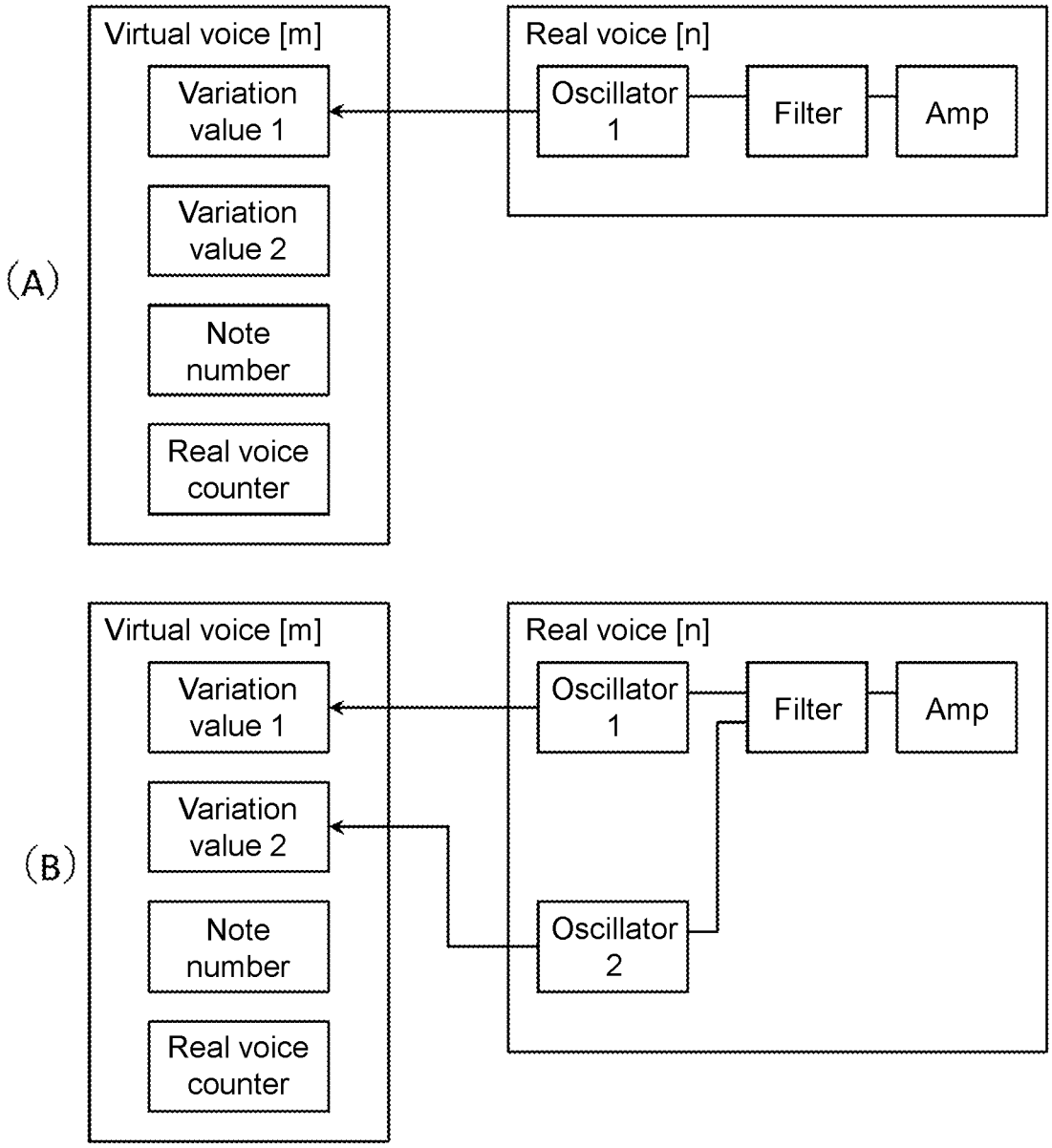
FIG. 27 is an explanatory diagram of a modification of the embodiment.

A reproduction circuit in the embodiment aforementioned for one real voice is configured to have two oscillators as shown in (B) of FIG. 27. However, a reproduction circuit may also be configured to have one oscillator for one real voice as shown in (A) of FIG. 27. Further, a reproduction circuit may be configured to have three or more oscillators for one real voice.

In the above embodiment, a sounding parameter such as a pitch is varied using a random number. On the other hand, it is also possible to adopt a configuration in which a sounding parameter for simulating variations in pitch or the like is provided for each timbre or each part. For example, a variation in a sounding parameter such as the pitch of each voice generated by an individual analog synthesizer to be simulated is measured and the measurement result is used as a variation value. In this case, a variation value to be included in virtual voice information is obtained using a parameterized value, instead of a random number, through calculation of "parameterized value×variation depth of pitch." The parameterized value may be edited by the user.

<Aging>

The aging of sounding parameters such as a pitch and a filter will be described. Some analog synthesizers experience a phenomenon in which the pitch of each voice (oscillator) becomes unstable due to the influence of temperature. For example, some analog synthesizers operate such that the pitch of each voice (oscillator) gradually changes after the power is turned on and is stabilized at a predetermined pitch after a while. It has been found that a certain analog synthesizer product is stabilized in pitch within about 2 hours after the power is turned on. The electronic musical instrument 10 (digital synthesizer) according to the present embodiment can simulate the characteristics of such an analog synthesizer by performing the following aging process on each virtual voice.

Figure 28:
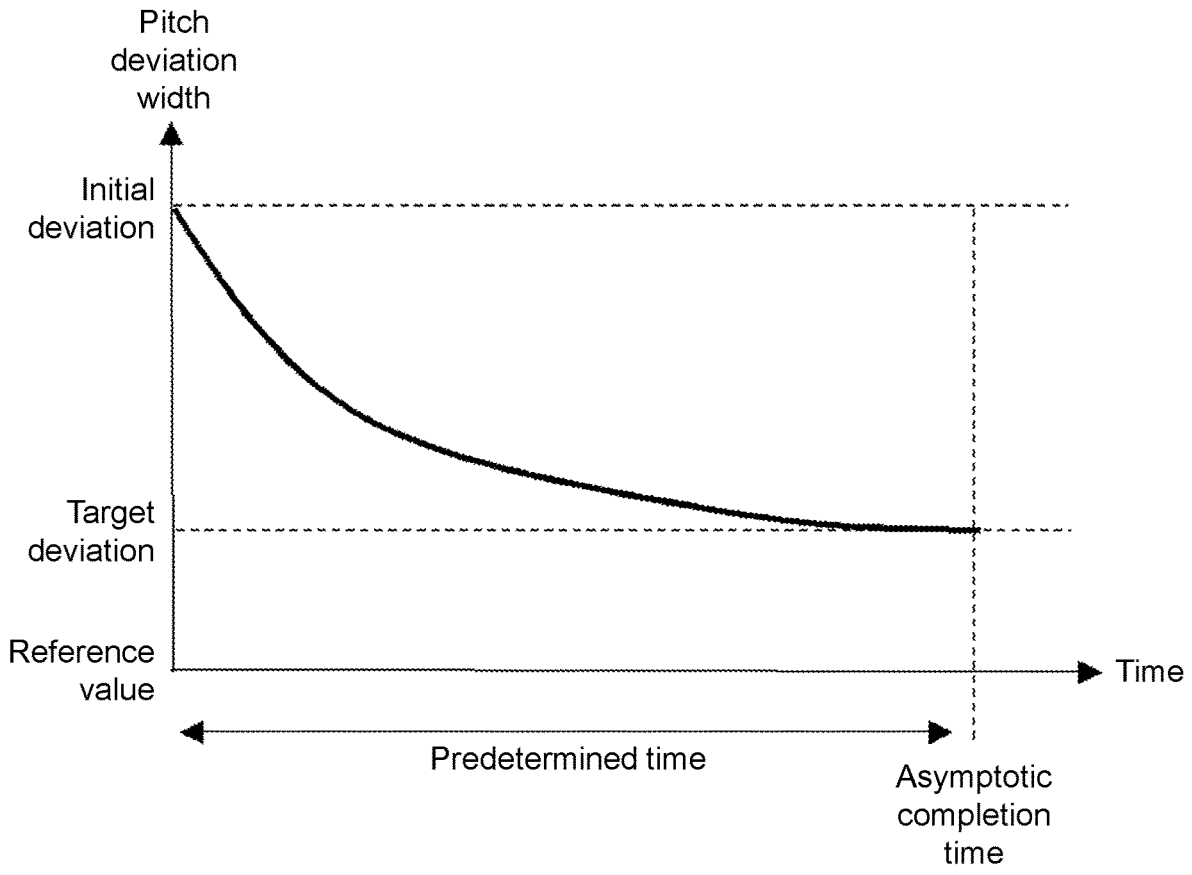
FIG. 28 is explanatory diagram of an aging process.

FIG. 28 shows a variation value of the pitch of each voice. Here, it is assumed that the pitch when the power is turned on corresponds to an initial deviation and the pitch reached over a predetermined time corresponds to the variation value of the pitch (a target deviation). These are set for each virtual voice, the pitch is set to the initial deviation at the start of power supply, and the pitch is changed such that it gradually approaches the target deviation over the predetermined time. After the lapse of the predetermined time, the pitch of each virtual voice is prevented from varying at the target deviation value.

The time when the value of the pitch gets close enough to the target deviation and becomes stable after the power is turned on (called an "asymptotic completion time") can be set. The asymptotic completion time can be set, for example, within a range of 0 to 2 hours. However, the asymptotic completion time may be longer than 2 hours.

The change of the pitch is not limited to that of the example of FIG. 28. In FIG. 28, the initial deviation of the pitch at the start of power supply is shown to deviate more than the pitch of the target deviation does. However, the deviation width of the initial deviation may be smaller than the deviation width of the target deviation. The initial deviation and the target deviation may also deviate below the reference value. Further, how the pitch is changed may be different for each virtual voice. For example, a curve having a different curvature, a straight line, an S-shaped curve, or a curve that asymptotically approaches while vibrating may be used. The user may be allowed to select the shape (type) of the line indicating the change of the pitch. An aging process may also be applied to a parameter other than the pitch (for example, a filter parameter).

The pitch may start asymptotically approaching (increasing toward) the target deviation from the time when a predetermined time has elapsed since the power was turned on (called an "asymptotic start time"). The asymptotic start time may be set by the user. The configurations shown in the embodiments can be appropriately combined without departing from the purpose.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A musical sound generation method comprising:

a control device assigning, when a performance operator among a plurality of performance operators has been operated for a part that has been set to sound a predetermined number of simulated voices of an analog synthesizer, at least one sounding parameter being a pitch of one or pitches of two or more voices, which form a timbre of a simulated voice of the analog synthesizer corresponding to a note number of the operated performance operator and are selected from a plurality of voices capable of being sounded, to a sound generation circuit;

the control device assigning, to the sound generation circuit, an information set selected from a plurality of information sets which are prepared for the predetermined number of simulated voices and each include a pitch variation value that applies a pitch variation to the sounding parameter of the one or two or more voices; and the sound generation circuit performing a sounding process of the one or two or more voices using the sounding parameter and the information set, wherein, when the one or two or more voices are generated using a plurality of oscillators included in the sound generation circuit, the information set includes pitch variation values respectively corresponding to the oscillators.

2. The musical sound generation method according to claim 1, wherein the predetermined number is determined according to the number of sounding voices of the analog synthesizer to be simulated.

3. The musical sound generation method according to claim 1, wherein the plurality of information sets are prepared for a part that has been set to sound simulated voices of the analog synthesizer and are not prepared for a part that has been set to sound voices other than the simulated voices of the analog synthesizer.

4. The musical sound generation method according to claim 1, wherein the pitch variation value is calculated from a random number and information indicating a variation depth, or a value indicating a variation measured using an actual analog synthesizer device is used as the pitch variation value.

5. A musical sound generation method comprising:

a control device assigning, when a performance operator among a plurality of performance operators has been operated for a part that has been set to sound a predetermined number of simulated voices of an analog synthesizer, at least one sounding parameter being a pitch of one or pitches of two or more voices, which form a timbre of a simulated voice of the analog synthesizer corresponding to a note number of the operated performance operator and are selected from a plurality of voices capable of being sounded, to a sound generation circuit;

the control device assigning, to the sound generation circuit, an information set selected from a plurality of information sets which are prepared for the predetermined number of simulated voices and each include a variation value that applies a variation to the sounding parameter of the one or two or more voices; and the sound generation circuit performing a sounding process of the one or two or more voices using the sounding parameter and the information set, wherein unused information sets among the plurality of information sets are registered in an unused list, each of the information sets in the unused list includes identification information of a performance operator that has triggered assignment to the sound generation circuit in the past, and when an information set is selected from the unused list in response to operation of a certain performance operator among the plurality of performance operators, an information set including identification information of the certain performance operator is preferentially selected.

6. The musical sound generation method according to claim 5, wherein, when an information set is assigned to the sound generation circuit, the information set is added with information indicating reference to a variation value by the sound generation circuit and removed from the unused list and, when sounding of the one or two or more voices has ended, the information indicating reference to a variation value by the sound generation circuit is removed and the information set is again registered in the unused list.

7. The musical sound generation method according to claim 5, wherein a voice having substantially the same features as a voice generated according to the operation of the certain performance operator is generated as a voice of the analog synthesizer when the certain performance operator has been operated again immediately after the operation of the certain performance operator ends.

8. The musical sound generation method according to claim 5, wherein the identification information of the performance operator is the note number.

9. A musical sound generation device comprising:

a first predetermined number of real voices provided for a plurality of parts;

a number of virtual voices, whose upper limit is a second predetermined number, provided for each of the parts;

a real voice assigner configured to assign at least one real voice among the first predetermined number of real voices for operation of a performance operator for a part that has been set to sound simulated voices of an analog synthesizer;

a virtual voice assigner configured to assign one of the virtual voices of the part; and a sound generation circuit configured to generate a musical sound on the basis of a sounding parameter being a pitch of the assigned real voice corresponding to a note number of the performance operator and a pitch variation value of the assigned virtual voice, wherein the real voices are shared by the plurality of parts, and wherein, when the one or two or more voices are generated using a plurality of oscillators included in the sound generation circuit, the information set includes pitch variation values respectively corresponding to the oscillators.

10. The musical sound generation device according to claim 9, wherein the second predetermined number are determined according to the number of sounding voices of the analog synthesizer to be simulated.

11. The musical sound generation device according to claim 9, wherein identification information of the performance operator is the note number.

12. The musical sound generation device according to claim 9, wherein the second predetermined number is smaller than the first predetermined number.

* * * * *